US010272705B2

(12) United States Patent
Von Essen et al.

(10) Patent No.: US 10,272,705 B2
(45) Date of Patent: Apr. 30, 2019

(54) FLUID EJECTION MODULE MOUNTING

(71) Applicant: FUJIFILM Dimatix, Inc., Lebanon, NH (US)

(72) Inventors: Kevin Von Essen, San Jose, CA (US); Paul A. Hoisington, Hanover, NH (US); Michael Rocchio, Hayward, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 297 days.

(21) Appl. No.: 15/431,218

(22) Filed: Feb. 13, 2017

(65) Prior Publication Data

US 2017/0217231 A1 Aug. 3, 2017

Related U.S. Application Data

(60) Continuation of application No. 15/174,138, filed on Jun. 6, 2016, now Pat. No. 9,566,810, which is a (Continued)

(51) Int. Cl.
*H01R 13/62* (2006.01)
*B41J 29/00* (2006.01)

(Continued)

(52) U.S. Cl.
CPC ..... *B41J 25/001* (2013.01); *B41J 2/1752* (2013.01); *B41J 25/003* (2013.01); *B41J 25/316* (2013.01);

(Continued)

(58) Field of Classification Search
CPC ..... B41J 25/001; B41J 25/316; B41J 25/003; B41J 25/34; B41J 2/1752; B41J 29/00
See application file for complete search history.

(56) References Cited

U.S. PATENT DOCUMENTS 4,509,622 A 4/1985 Morszeck
5,373,633 A 12/1994 Satoi (Continued)

FOREIGN PATENT DOCUMENTS

CN 1997521 A 7/2007
CN 101663166 A 3/2010

(Continued)

OTHER PUBLICATIONS

Deming, et al., "Fluid Ejection Module Mounting ".U.S. Appl. No. 61/641,227, filed May 1, 2012, to be published by the USPTO with the file history of this application.

(Continued)

*Primary Examiner* — Ryan J. Walters
(74) *Attorney, Agent, or Firm* — Fish & Richardson P.C.

(57) ABSTRACT

A fluid ejection module mounting apparatus, including a module mount having a horizontal portion and a vertical portion, a fluid ejection module mounted to the module mount, and a clamp assembly including a recessed portion, a clamp along a wall of the recessed portion, and a lever coupled to the clamp and configured to move the clamp from an open position to a closed position. The horizontal portion has an opening configured to receive a fluid ejection module and the vertical portion has a protruding portion. The protruding portion of the module mount is configured to mate with the recessed portion of the clamp assembly.

14 Claims, 17 Drawing Sheets

Related U.S. Application Data division of application No. 13/828,608, filed on Mar. 14, 2013, now Pat. No. 9,358,818.

(51) Int. Cl.

| | |
|---|---|
| ***B41J 25/00*** | (2006.01) |
| ***B41J 2/175*** | (2006.01) |
| ***B41J 25/34*** | (2006.01) |
| ***B41J 25/316*** | (2006.01) |

(52) U.S. Cl.

CPC ..... *B41J 25/34* (2013.01); *B41J 29/00* (2013.01); *Y10T 29/4978* (2015.01); *Y10T 29/53091* (2015.01)

(56) References Cited

U.S. PATENT DOCUMENTS

| | | | |
|---|---|---|---|
| 5,627,577 | A | 5/1997 | Buican |
| 6,371,672 | B1 | 4/2002 | Pirie et al. |
| 7,413,284 | B2 | 8/2008 | Higginson et al. |
| 7,794,079 | B2 | 9/2010 | Von Essen et al. |
| 2004/0090488 | A1 | 5/2004 | Nellen |
| 2008/0070437 | A1 | 3/2008 | Nakano et al. |
| 2008/0211872 | A1 | 9/2008 | Hoisington et al. |
| 2010/0091060 | A1 | 4/2010 | Von Essen et al. |
| 2011/0109696 | A1 | 5/2011 | Essen |
| 2011/0128324 | A1 | 6/2011 | Essen et al. |
| 2011/0132046 | A1 | 6/2011 | Tonelli |
| 2011/0310195 | A1 | 12/2011 | Nakamura |

FOREIGN PATENT DOCUMENTS

| | | | |
|---|---|---|---|
| CN | 102036826 | A | 4/2011 |
| CN | 102131994 | A | 7/2011 |
| EP | 2384896 | | 11/2011 |
| JP | 2009-174879 | | 8/2009 |
| JP | 2010-069651 | | 4/2010 |
| JP | 2011-136507 | | 7/2011 |
| WO | WO2009142927 | A1 | 11/2009 |

OTHER PUBLICATIONS

International Search Report and Written Opinion, PCT/US2014/026067, dated Aug. 6, 2014, 12 pages.

PCT International Preliminary Report on Patentability, PCT/US2014/026067, dated Sep. 24, 2015, 8 pages.

State Intellectual Property Office of the People's Republic of China, the First Office Action, Chinese Application No. 201480015224.8, dated Jun. 24, 2016, 14 pages.

European Search Report, European Application No. 14773685.4, dated Aug. 22, 2017, 4 pages.

Communication pursuant to Article 94(3) EPC, European Application No. 14773685.4, dated Sep. 15, 2017, 11 pages.

JP Office Action in Japanese Application No. 2017-199423, dated Oct. 3, 2018, 12 pages (with English Translation).

Communication Pursuant to Article 94(3) EPC, European Application No. 14773685.4, dated Jul. 10, 2018, 10 pages.

FLUID EJECTION MODULE MOUNTING

CROSS-REFERENCE TO RELATED APPLICATIONS

This application is a continuation application of and claims then benefit of priority to U.S. application Ser. No. 15/174,138, filed on Jun. 6, 2016, which is a divisional of U.S. application Ser. No. 13/828,608, filed on Mar. 14, 2013, now U.S. Pat. No. 9,358,818, issued on Jun. 7, 2016, the contents of which are hereby incorporated by reference.

TECHNICAL FIELD

The following description relates to mounting a fluid ejection module to a mounting apparatus.

BACKGROUND

An ink jet printer typically includes an ink path from an ink supply to an ink nozzle assembly that includes nozzles from which ink drops are ejected. Ink drop ejection can be controlled by pressurizing ink in the ink path with an actuator, for example, a piezoelectric deflector, a thermal bubble jet generator, or an electrostatically deflected element. A typical printhead has a line or an array of nozzles with a corresponding array of ink paths and associated actuators, and drop ejection from each nozzle can be independently controlled. In a so-called "drop-on-demand" printhead, each actuator is fired to selectively eject a drop at a specific location on a medium. The printhead and the medium can be moving relative one another during a printing operation.

As one example, a printhead can include a semiconductor printhead body and a piezoelectric actuator. The printhead body can be made of silicon etched to define pumping chambers. Nozzles can be defined by a separate layer that is attached to the printhead body. The piezoelectric actuator can have a layer of piezoelectric material that changes geometry, or flexes, in response to an applied voltage. Flexing of the piezoelectric layer pressurizes ink in a pumping chamber located along the ink path.

Printing accuracy can be influenced by a number of factors. Precisely positioning the nozzles relative to the medium can be necessary for precision printing. If multiple printheads are used to print contemporaneously, then precise alignment of the nozzles included in the printheads relative to one another also can be critical for precision printing. Maintaining alignment of the printheads during and after alignment and mounting can be important.

SUMMARY

In one aspect, the systems, apparatus, and methods disclosed herein feature a fluid ejection module mounting apparatus, including a module mount having a horizontal portion and a vertical portion, a fluid ejection module mounted to the module mount, and a clamp assembly including a recessed portion, a clamp along a wall of the recessed portion, and a lever coupled to the clamp and configured to move the clamp from an open position to a closed position. The horizontal portion has an opening configured to receive a fluid ejection module and the vertical portion has a protruding portion. The protruding portion of the module mount is configured to mate with the recessed portion of the clamp assembly.

Within the mounting apparatus, the module mount can further include precision surfaces in the x, y, and z direction that contact corresponding alignment contact points in the x, y and z direction on the clamp assembly.

Within the mounting apparatus, the clamp assembly can further include a θz adjustment mechanism configured to move the fluid ejection module in the θz direction relative to the clamp assembly. The θz adjustment mechanism can include a differential screw being configured to move 50 microns or less per revolution. The θz adjustment mechanism can be accessible from more than one surface of the clamp assembly.

Within the mounting apparatus, the clamp assembly can further include a x adjustment mechanism configured to move the fluid ejection module in the x direction relative to the clamp assembly. The x adjustment mechanism can include a cam assembly including a cam that is sloped to an angle, α. The cam is sloped to an angle, α, such that one rotation of the cam translates into moving the fluid ejection module over one pixel in the x-direction. The x adjustment mechanism can be accessible from more than one surface of the clamp assembly.

In various implementations, one or more of the following features may also be included. The clamp can include a spring. The clamp assembly can further include a cam plate coupled to the lever and the clamp. The cam plate can be coupled to a spring. The clamp assembly can include a plurality of clamps. The clamp assembly can mount to the frame.

In various implementations, the mounting apparatus can further include a plurality of fluid ejection modules, a plurality of module mounts, and a plurality of clamp assemblies, wherein each fluid ejection module is mounted to a module mount, and each module mount is mounted to a clamp assembly. The mounting apparatus can also include a frame, wherein the clamp assemblies are mounted to the frame.

In another aspect, the systems, apparatus, and methods disclosed herein feature loosely securing a plurality of clamp assemblies to a frame, securing an alignment jig to the plurality of clamp assemblies, firmly securing the plurality of clamp assemblies to the frame, removing the alignment jig from the plurality of clamp assemblies, and securing a plurality of module mount assemblies to the plurality of clamp assemblies. Securing an alignment jig to the plurality of clamp assemblies includes placing the alignment jig in the plurality of clamp assemblies, and moving a lever on each clamp assembly from an open position to a closed position such that a clamp on each clamp assembly secures the alignment jig to the clamp assembly. Each module mount assembly comprises a fluid ejection module mounted to a module mount.

Some implementations can include one or more of the following features: aligning a plurality of fluid ejection modules to a plurality of module mounts, and bonding the plurality of fluid ejection modules to the plurality of module mounts to form the plurality of module mount assemblies. Aligning the plurality of fluid ejection modules to the plurality of module mounts can set the x, y, and θz direction for each fluid ejection module relative to the corresponding clamp assembly. At least one module mount assembly can be adjusted relative to a corresponding clamp assembly in the x direction using an x adjustment mechanism. At least one module mount assembly can be adjusted relative to a corresponding clamp assembly in the θz direction using a θz adjustment mechanism.

In another aspect, the systems, apparatus, and methods disclosed herein feature a mounting apparatus including an alignment jig having a plurality of protruding portions, and a plurality of clamp assemblies. Each clamp assembly includes a recessed portion, wherein a corresponding protruding portion of the alignment jig is configured to mate with the recessed portion, a clamp along a wall of the recessed portion, and a lever coupled to the clamp and configured to move the clamp from an open position to a closed position.

Within the mounting apparatus, each protruding portion can slidably connect with a recessed portion of each clamp assembly. The mounting apparatus can further include a frame, wherein the plurality of clamp assemblies mount to the frame.

Implementations of the invention(s) can realize one or more of the following advantages. A mounting apparatus is provided to achieve precise alignment of a fluid ejection module relative to a supporting print frame. The mounting apparatus can facilitate easy installation and removal of a single fluid ejection module from the print frame, for example, to replace or repair the device. The alignment process can use an alignment jig to accurately align a plurality of clamp assemblies to a print frame. Without using an alignment jig, the individual clamp assemblies must be individually aligned one at a time. The alignment jig facilitates aligning the plurality of clamp assemblies simultaneously. In addition, the alignment jig can be precisely machined within millionths of an inch. By using the same jig, the alignment can be repeatable from print bar to print bar. Using a jig can also remove alignment errors encountered when aligning a single fluid ejection module at a time. The clamp assemblies can include clamps that are spring-loaded, so that the clamps provide a constant clamping force. Unlike spring-loaded clamps, other securing means (e.g., screws) can have variable forces. The clamping force of the spring-loaded clamps can also be repeatable from clamp assembly to clamp assembly.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Many of the levels, sections and features are exaggerated to better show the features, process steps, and results. Like reference numbers and designations in the various drawings indicate like elements.

DETAILED DESCRIPTION

A method, apparatus, and system are described for mounting a fluid ejection module to a frame (which may be referred to herein as a "print frame") of a printer system. A typical printer system may include one or several fluid ejection modules. When combining two or more fluid ejection modules in a printing system, each module can be aligned relative to the print frame, and relative to one another, to achieve printing accuracy.

In the case of a print bar having a plurality of fluid ejection modules, if a single module fails, it is desirable to replace the single module rather than the entire print bar. To make the modules replaceable, each module can be releasably secured to the print bar.

Figure 1:
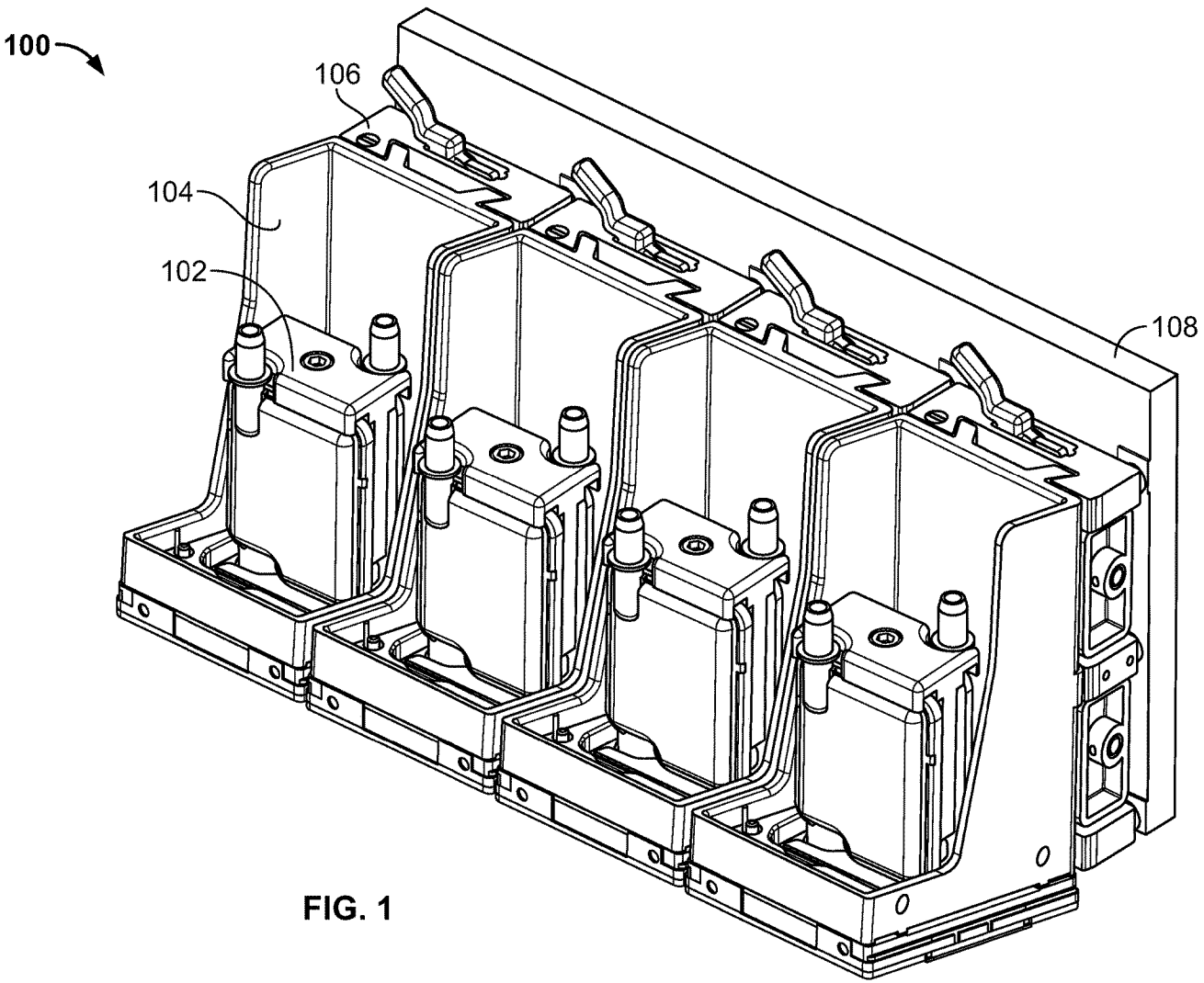
FIG. 1 is a perspective view of an assembled print bar.

FIG. 1 shows an assembled print bar 100 including a plurality of fluid ejection modules 102, each module 102 being secured to a module mount 104. Each module mount 104 is secured to a corresponding clamp assembly 106, and the clamp assemblies 106 are secured to a frame 108. Alternatively, a single clamp assembly could hold a plurality of fluid ejection modules with the clamp assembly being mounted to a frame. In another configuration, the frame and the clamp assembly could be a single part, and the modules could be mounted to the frame/clamp assembly. To prevent misalignment caused by thermal expansion, the frame and the clamp assembly can be made of a material having a low coefficient of thermal expansion (CTE), such as invar, kovar, or silicon carbide. The module mount can be made of stainless steel, kovar, or silicon carbide.

Figure 2B:
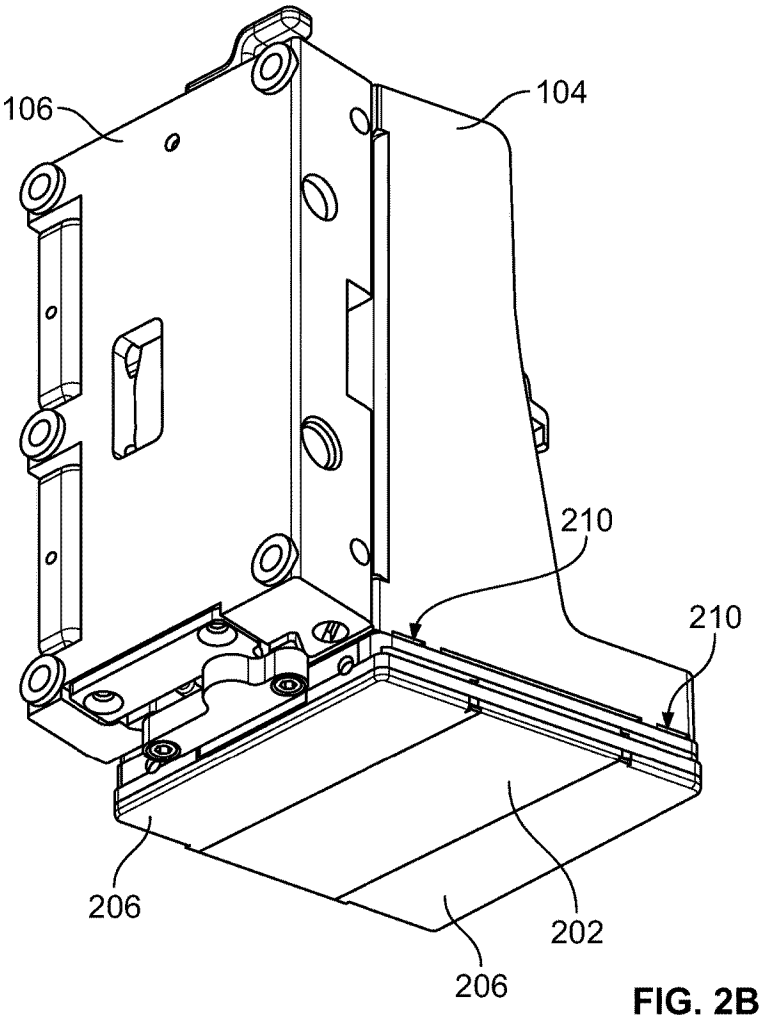
FIGS. 2A and 2B are perspective views of a mounting apparatus including a module mount and clamp assembly.
Figure 2A:
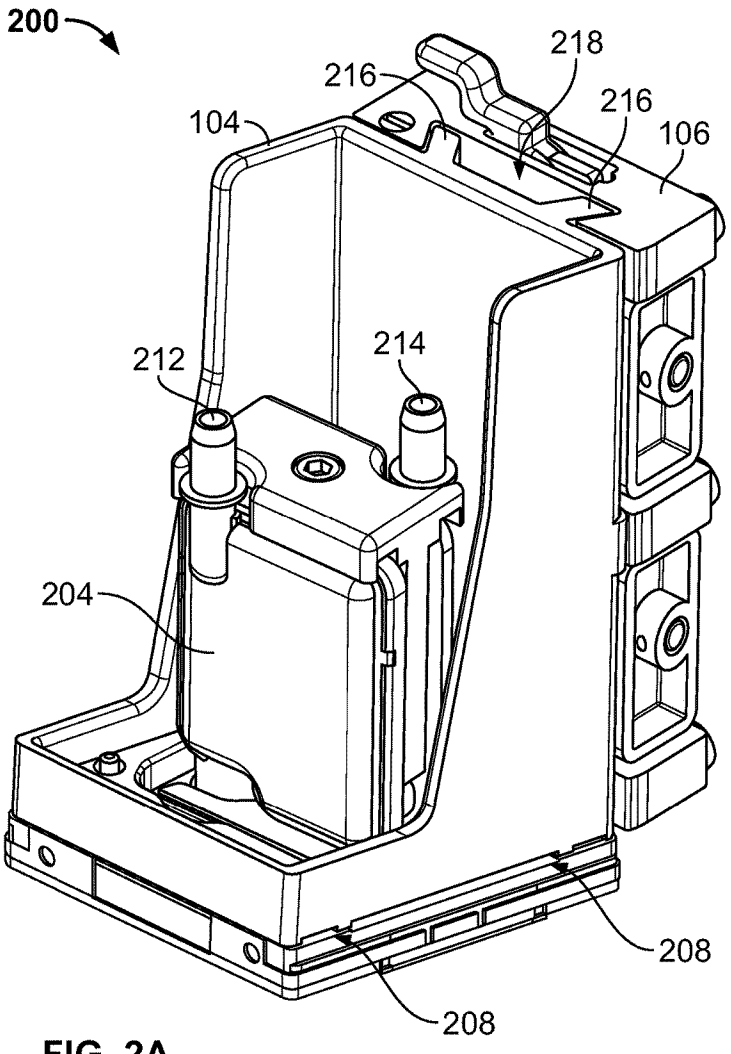

FIGS. 2A and 2B show a module mount assembly 200 secured to a clamp assembly 106 including a module 102 attached to a module mount 104. The fluid ejection module 102 can include a semiconductor substrate 202 (e.g., silicon) fabricated using semiconductor processing techniques. Each fluid ejection module 102 can also include a housing 204 to support the substrate 202, along with other components such as a flexible circuit (not shown) to receive data from an external processor and to provide drive signals to the module. A plurality of fluid flow paths can be formed in the semiconductor substrate 202 for ejection of droplets of a fluid. The fluid can be, for example, a chemical compound, a biological substance, or ink.

The semiconductor substrate can also include a plurality of actuators to cause fluid to be selectively ejected from the flow paths. Thus, each flow path with its associated actuator provides an individually controllable micro-electromechanical system (MEMS) fluid ejector. The substrate can include a flow-path body, a nozzle layer and a membrane layer. The flow-path body, nozzle layer and membrane layer can each be silicon, e.g., single crystal silicon. The fluid flow path can include an inlet, an ascender, a pumping chamber adjacent the membrane layer, and a descender that terminates in a nozzle formed through the nozzle layer. Activation of the actuator causes the membrane to deflect into the pumping chamber, forcing fluid out of the nozzle.

A fluid inlet 212 and a fluid outlet 214 can be formed in the housing 204. In other implementations, the fluid ejection module does not include a fluid outlet (which optionally can provide for a recirculation scheme for the printing fluid).

FIG. 2B shows an example fluid ejection module 102 including a mounting component 206 having a mounting surface 208. The mounting surface 208 of the module is bonded (e.g., using an adhesive, such as room temperature epoxy) to a mounting surface 210 of the module mount 104. A protruding portion 216 (e.g., dovetail) of the module mount can be mated with the clamp assembly 106. For example, the protruding portion 216 can slidably connect with the recessed portion 218. By having the protruding portion vertically slidable (i.e., perpendicular to the face of semiconductor substrate 202), this can help with lining up the nozzle surfaces of adjacent fluid ejection modules 102. In addition, the vertically slidable mount can help with clearing and not disturbing adjacent modules 102.

Figure 3:
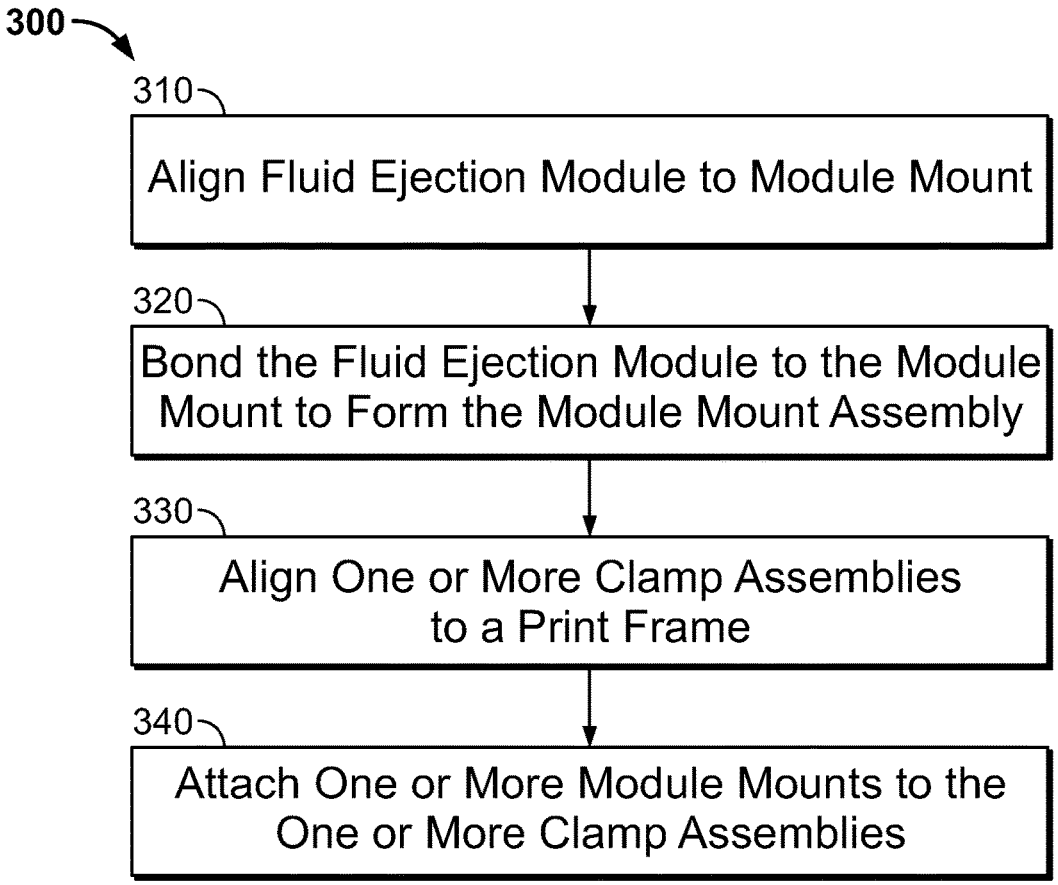
FIG. 3 is a flowchart of an example process for mounting a fluid ejection module to a print frame.

FIG. 3 is a flowchart showing an example process 300 for mounting a fluid ejection module to a print frame. For illustrative purposes, the process 300 shall be described in the context of mounting the example fluid ejection module 102 to the example print frame 108. However, it should be understood the process 300 can be implemented to mount a differently configured fluid ejection module to the same or a differently configured print frame.

The fluid ejection module 102 is positioned adjacent to the module mount 104 with the mounting surface 208 facing the module mount 104. An alignment apparatus aligns the module 102 to the module mount 104 using fiducial marks on an alignment mask and the nozzle layer (step 310), as discussed in more detail below. A first adhesive is applied to the mounting surface 210 of the module mount, to the mounting surface 208 (see FIGS. 2A and 2B) of the fluid ejection module, or both. The first adhesive can be formed from a material that allows for relative movement between the fluid ejection module and the module mount to facilitate the alignment process. For example, the first adhesive can be an epoxy, e.g. room temperature curing epoxy (such as Araldite® 5863-A/B, 2011/A, 2013/A), thermal curing epoxy, or UV curing epoxy. Once alignment is achieved, a second adhesive that is fast curing but not necessarily a robust adhesive (e.g., cyanoacrylate) can be applied to the sides of the module mount assembly to secure the fluid ejection module to the module mount while the first adhesive finishes curing (step 320). Once the first adhesive is cured, no significant relative movement of the fluid ejection module and the module mount is possible.

One or more clamp assemblies 106 are aligned and attached to the print frame 108, for example, using an alignment jig, which is discussed in more detail below. (step 330) The clamp assemblies can be attached to the print frame, for example, by screws received within threaded openings 902 (see FIG. 9) formed within the print frame. Alternatively, the clamp assemblies can be bonded to the frame with an adhesive. The module mount assemblies 200 can then be loaded into the clamp assemblies to form a populated print bar. (step 340) As previously mentioned, preferably the module mount is detachably secured to the print frame to allow for relatively easy removal at a later time without damaging the print frame.

Figure 4:
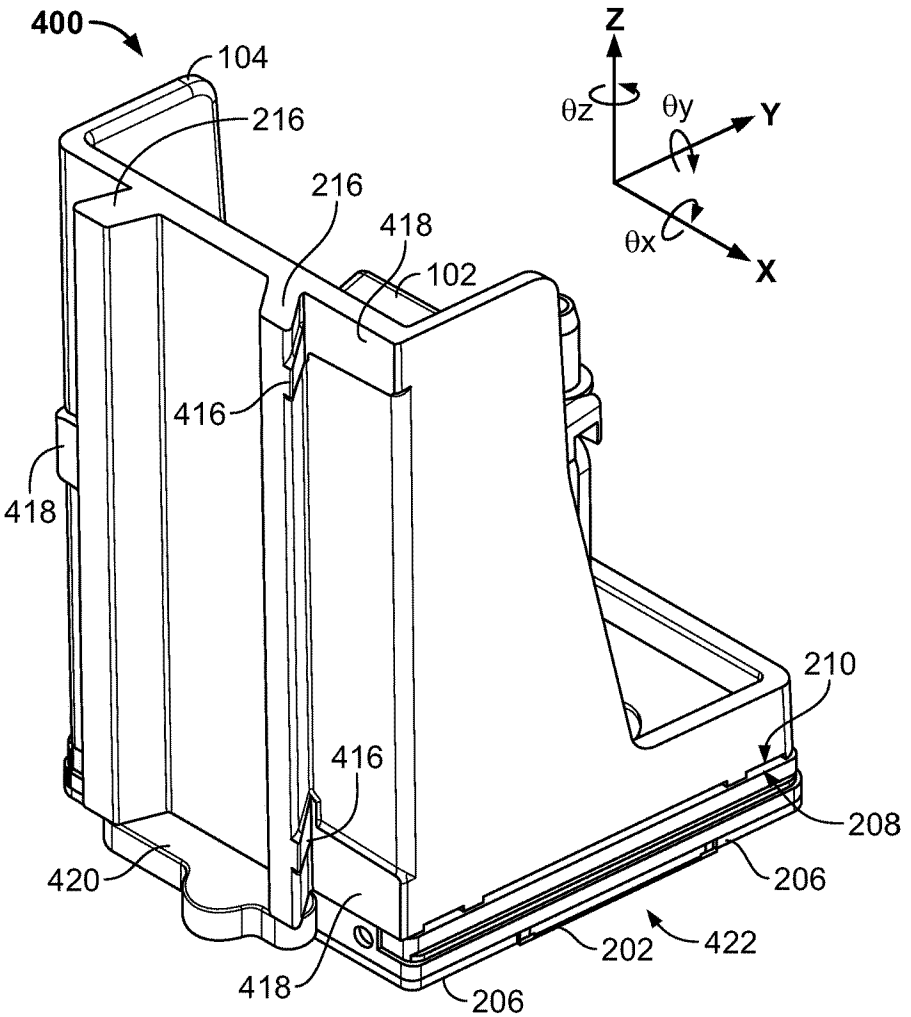
FIG. 4 is a perspective view of a module mount assembly including a module mount and a fluid ejection module.

FIG. 4 shows a module mount 104 including precision surfaces to align the fluid ejection module to the print frame. The precision machining of the module mount can set three degrees of freedom (e.g., θx, θy, and z) between the module and the print frame. For example, the x precision surfaces set the θy direction, the y precision surfaces set the θx direction, and the z precision surface sets the z direction (e.g., height).

A precision surface can be an entire surface of the module mount or only a portion of a surface, such as an alignment datum that is a raised or recessed feature. The precision surface can be machined using precision grinding. On the module mount, the x and y precision surfaces are machined perpendicular to the z precision surface, for example, within ±10 microns. The precision surfaces can have a surface profile within ±10 microns or less, such as ±3 microns. The nozzle surface 422 to the x and y precision surface can have a perpendicularity within ±25 microns. The distance from a nozzle surface 422 to a mounting surface 208 of the mounting component 206 can be within ±50 microns.

FIG. 4 shows a module mount 106 having alignment datums, including two x datums 416, three y datums 418, and one z datum 420. For example, the x alignment datums 416 are raised features on a surface of the protruding portion 216. The y alignment datums 418 are raised features on a back surface of the module mount 104 that contact the clamp assembly. The z alignment datum 420 is a surface of the module mount that is perpendicular to the x and y alignment datums.

Figure 6:
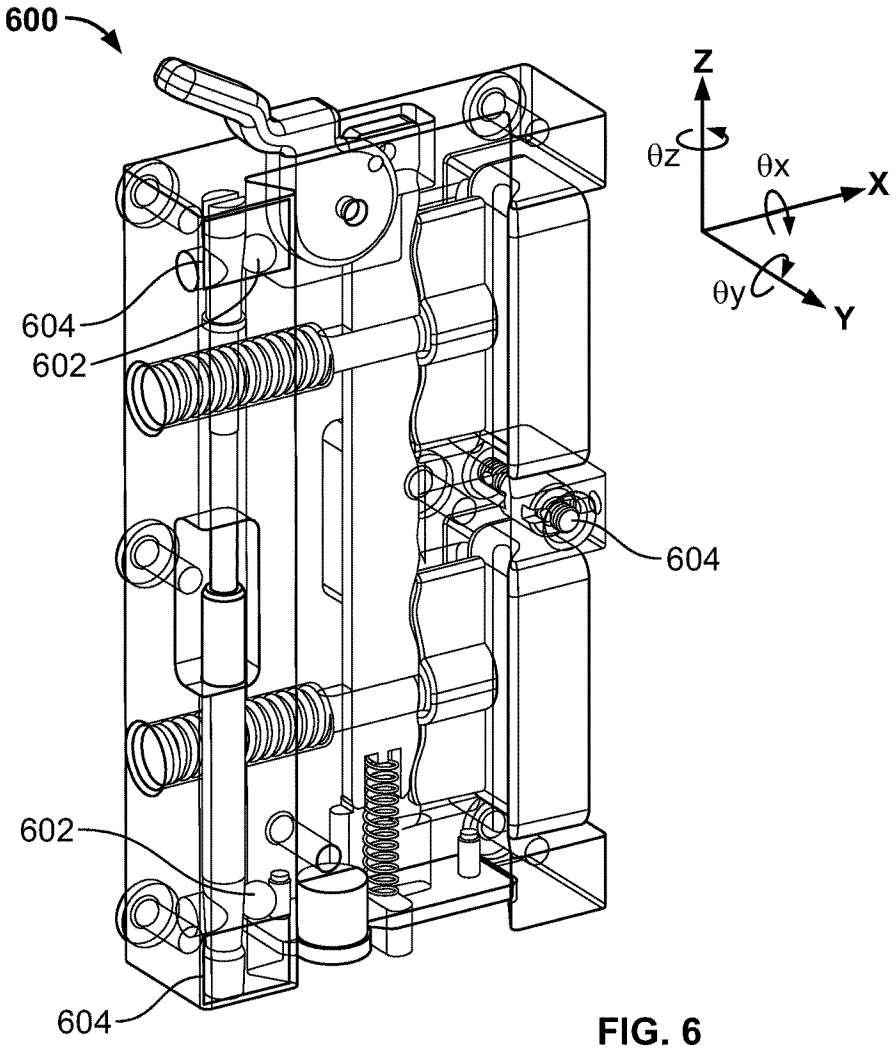
FIG. 6 is a perspective view of a clamp assembly (rendered in a partially transparent mode for visibility of components).

FIG. 6 shows a clamp assembly 600, having corresponding x, y, and z contact points, 602, 604, 606. For example, the x contact points 602 are located on an interior surface of the recessed portion 218. They contact points 604 are located on an exterior surface of the clamp assembly facing the module mount. The z contact point is located near an end of the recessed portion 218. The contact points can be set to a nominal position that is adjustable. For example, the x and y contact points can adjust the module relative to the clamp assembly in the x and Oz direction, respectively, as discussed below in more detail. The contact points can include magnets. For example, the z contact point can include a magnet. The magnet can hold the module mount in place prior to clamping the module mount to the clamp assembly. When the module mount is clamped to the clamp assembly, the alignment datums and contact points align the module to the print frame in θx, θy, and z direction. The remaining degrees of freedom (i.e., x, y, and Oz direction) are set when the module is mounted in the module mount. Adjusting the position of the one or more of the contact points of a clamp assembly brings the plurality of nozzles of the ejection module attached to the clamp assembly via a module mount into a desired alignment with the frame.

Figure 5A:
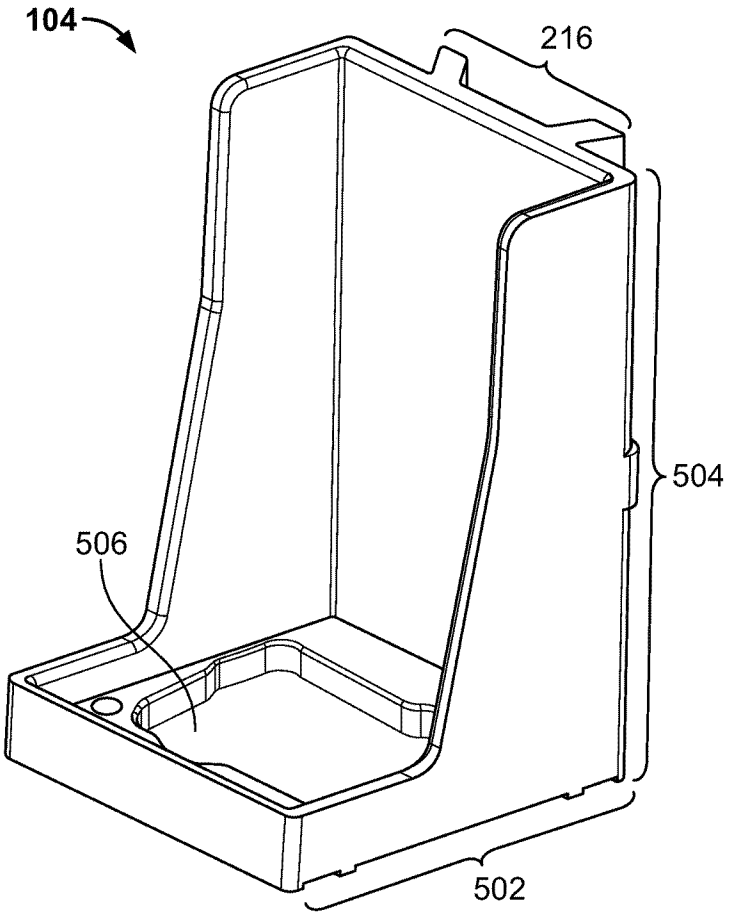
FIGS. 5A and 5B are perspective views of the module mount.
Figure 5B:
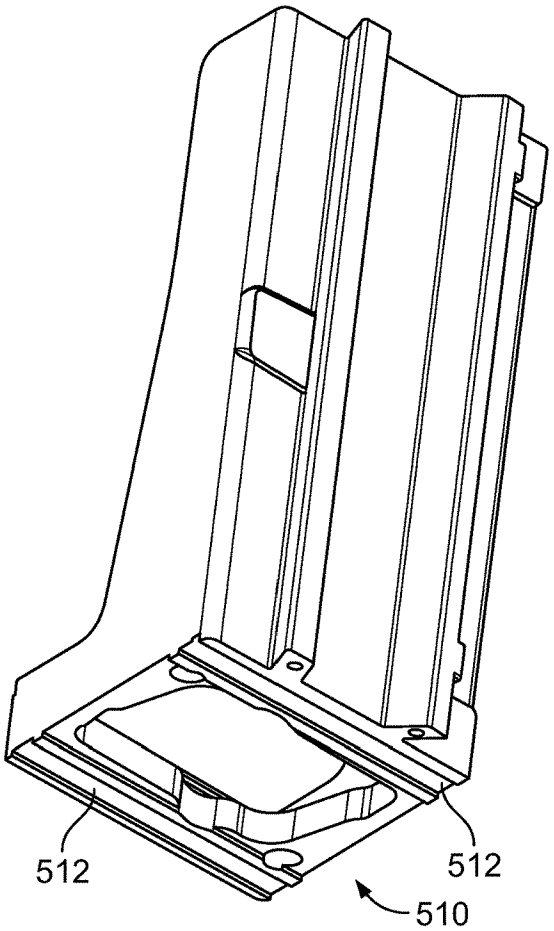

The module is mounted to the module mount using an aligning apparatus to form a module mount assembly. FIGS. 5A and 5B shows a module mount 104 having an L-shape including a horizontal portion 502 and a vertical portion 504. The horizontal portion 502 can have an opening 506 for receiving a fluid ejection module while the vertical portion 504 can have a protruding portion 216 (e.g., dovetail) that mates with a clamp assembly. The fluid ejection module can be inserted through the opening 506 from the bottom surface 510 of module mount. The mounting surface 208 of the module can be attached to the mounting surface 210 of the module mount, such as with an adhesive (e.g., BCB) or screws. FIG. 5B shows the mounting surface of the module mount having grooves 512 for receiving adhesive.

Figure 7A:
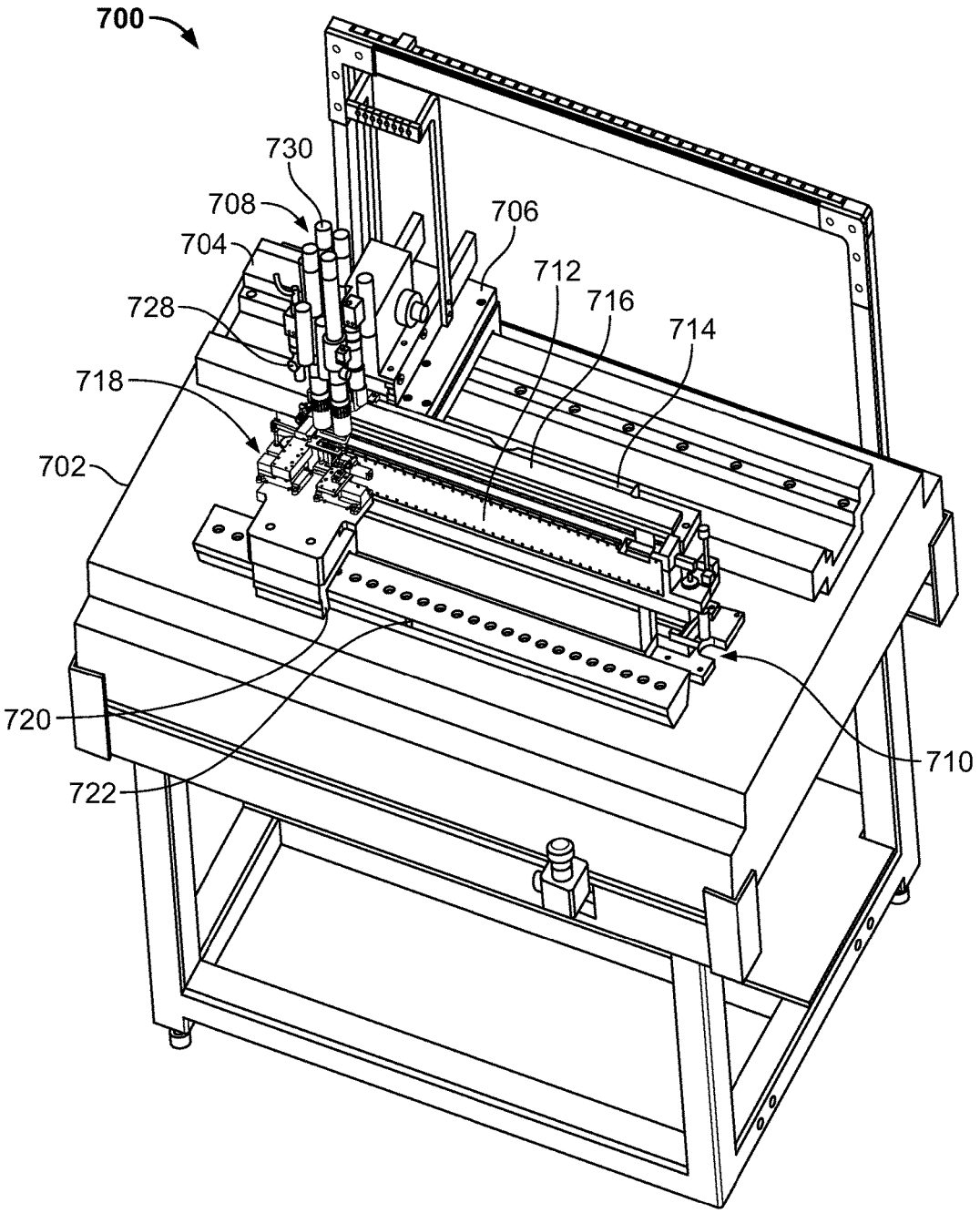
FIG. 7A is a perspective view of an alignment apparatus.

FIG. 7A shows an example alignment apparatus 700 that can be used to align the fluid ejection module to the module mount. The alignment apparatus 700 is one example of a device that can be used to achieve the alignment step 310 described above. However, it should be understood that other configurations of the alignment apparatus 700 can be used, and the apparatus described is but one example. For illustrative purposes, the alignment apparatus 700 is described in the context of aligning the fluid ejection module to the module mount, although it should be understood that the alignment apparatus 700 can be used to align a differently configured fluid ejection module to the same or a differently configured module mount.

In this implementation, the alignment apparatus 700 includes a base 702. A camera support rail 704 is mounted on the base 702, and a camera support 706 is mounted on, and configured to move along, the camera support rail 704. The camera support 706 supports a camera assembly 708. A print frame support 710 is also mounted on the base 702. The print frame support 710 supports the print frame 712 and a mask holder 714. The mask holder 714 supports an alignment mask 716. The alignment mask 716 can be used together with the camera assembly 708 to align the fluid ejection module to the module mount. A manipulator assembly 718 is mounted to the base 702 by a manipulator base 720 and a manipulator rail 722. The manipulator assembly 718 is configured to move the fluid ejection module relative to the module mount. The manipulator base 720 is configured to move along the manipulator rail 722.

Figure 7B:
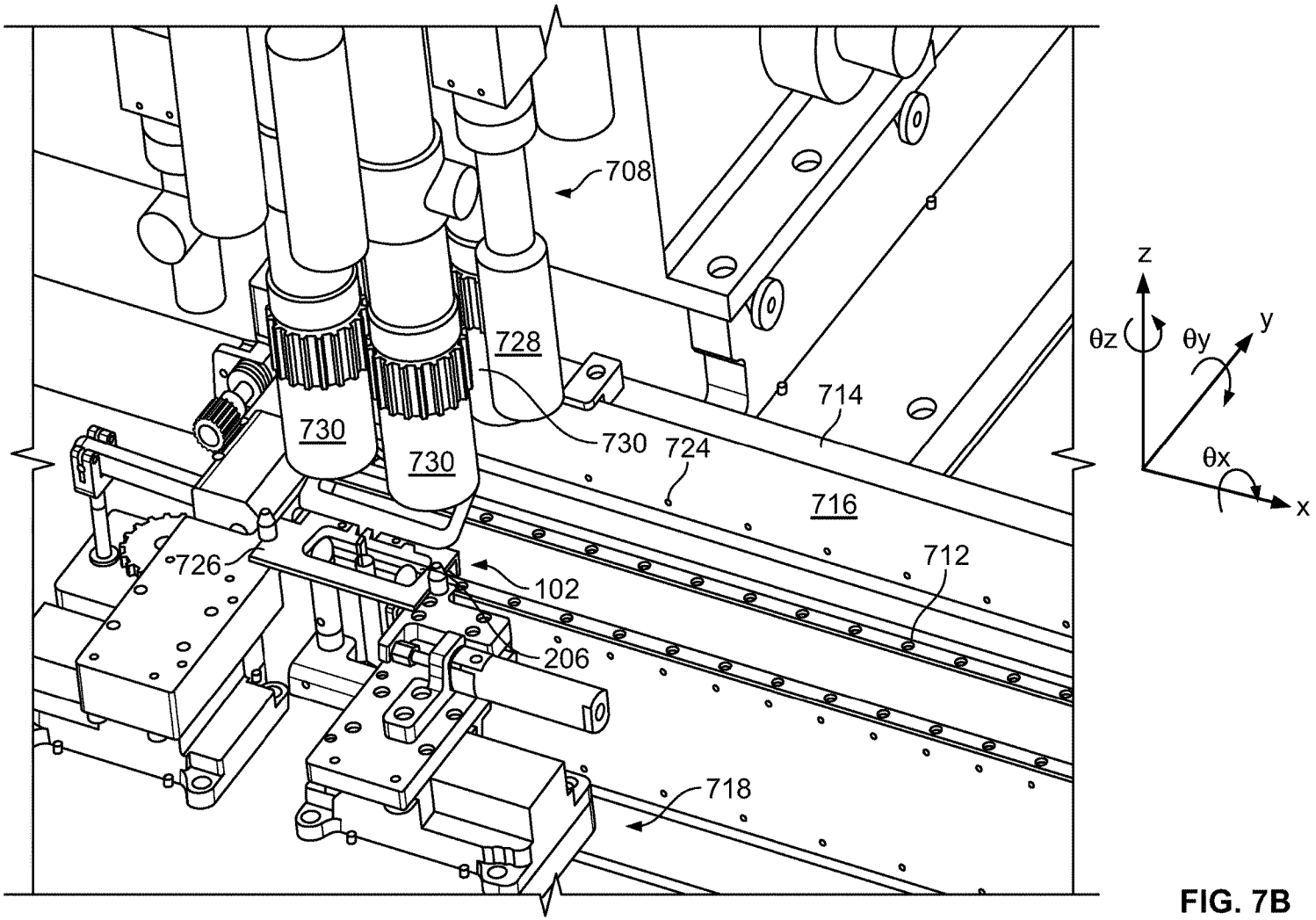
FIG. 7B is a close-up view of a portion of the alignment apparatus.

FIG. 7B is a close-up view of a portion of the alignment apparatus 700. The fluid ejection module 102 is placed in the module mount 104. Before placing the module 102 in the module mount, an adhesive can be applied to the module mount, module, or both. The module mount is positioned between the fluid ejection module and the print frame. The mask holder 714 supports the alignment mask 716, and the alignment mask 716 includes fiducials 724, which are discussed in more detail below. The manipulator assembly 718 includes a manipulator plate 726 configured such that movement of the manipulator plate 726 effects movement of the fluid ejection module 102 relative to the module mount, e.g. x, y, and θz direction.

In this implementation, the camera assembly 708 includes two low magnification cameras 728 and four high magnification cameras 730, although more or fewer cameras can be used. The high magnification cameras 730 can be calibrated using a calibration mask 732 (see FIG. 7E), as discussed in more detail below.

Figure 7C:
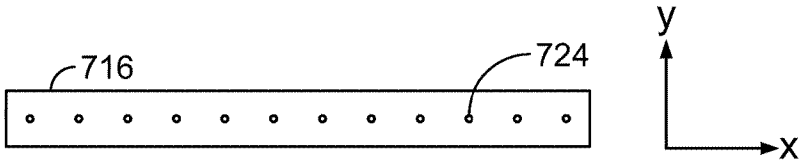
FIG. 7C is a schematic representation of an alignment mask.
Figure 7D:
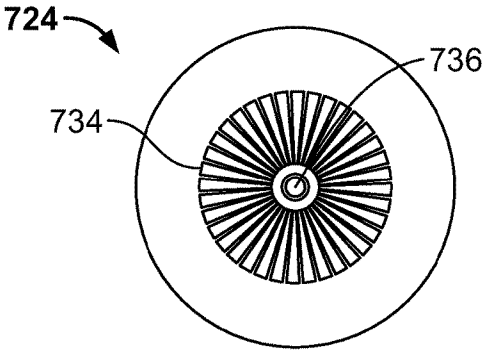
FIG. 7D is a schematic representation of a fiducial.

FIG. 7C is a schematic representation of an implementation of the alignment mask 732. The alignment mask includes one row of fiducials 724. The fiducials 724 can be used as reference marks for aligning the fluid ejection modules. For example, the fiducials 724 can be arranged in a line in the x-direction that is parallel to an edge of the print frame 712 (shown in FIG. 7B). FIG. 7D is a schematic representation of an implementation of the fiducial 724. In this implementation, the fiducial 724 includes conspicuity features 734 arranged around a fiducial point 736. The conspicuity features 734 facilitate locating of the fiducial point 736 with the high magnification cameras 730. References in this disclosure to alignment with a fiducial can refer to alignment with a fiducial point. That is, for example, aligning a high magnification camera 730 with a fiducial 724 can include aligning the high magnification camera 730 with a fiducial point 736. The conspicuity features can be sized to be conspicuous to a low magnification camera, to a camera with no magnification, or to a human eye.

Figure 7E:
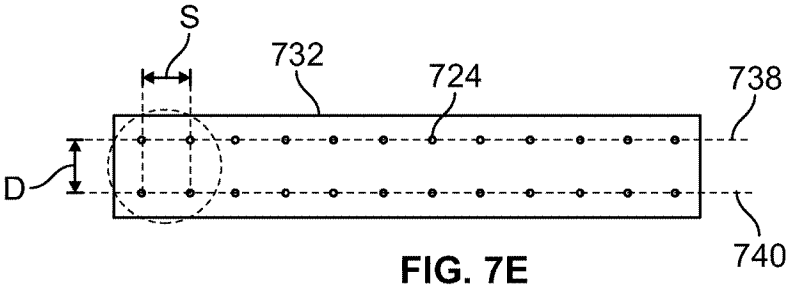
FIG. 7E is a schematic representation of a calibration mask.

FIG. 7E is a schematic representation of an implementation of the calibration mask 732. The calibration mask 732 includes fiducials 724 arranged in a first row 738 and a second row 740. The fiducials 724 are configured such that the four high magnification cameras 730 are properly positioned when each of the four high magnification cameras 730 is aligned with a certain fiducial. A high magnification camera 730 is aligned with a fiducial 724 when the center of the field of view of the high magnification camera, or some other reference point within the field of view of the high magnification camera, is aligned with a fiducial. For example, the high magnification cameras 730 can be calibrated by alignment with the four fiducials 724 shown within a broken circle in FIG. 7E. In this implementation, the spacing S between the fiducials in the first row 738 is equal to the spacing S between the fiducials in the second row 740. The first row 738 and the second row 740 are parallel to each other and separated by a distance D. In some implementations, once calibrated, the four high magnification cameras 730 are maintained in a fixed relation with respect to each other after alignment, unless and until calibration is performed again.

Figure 7F:
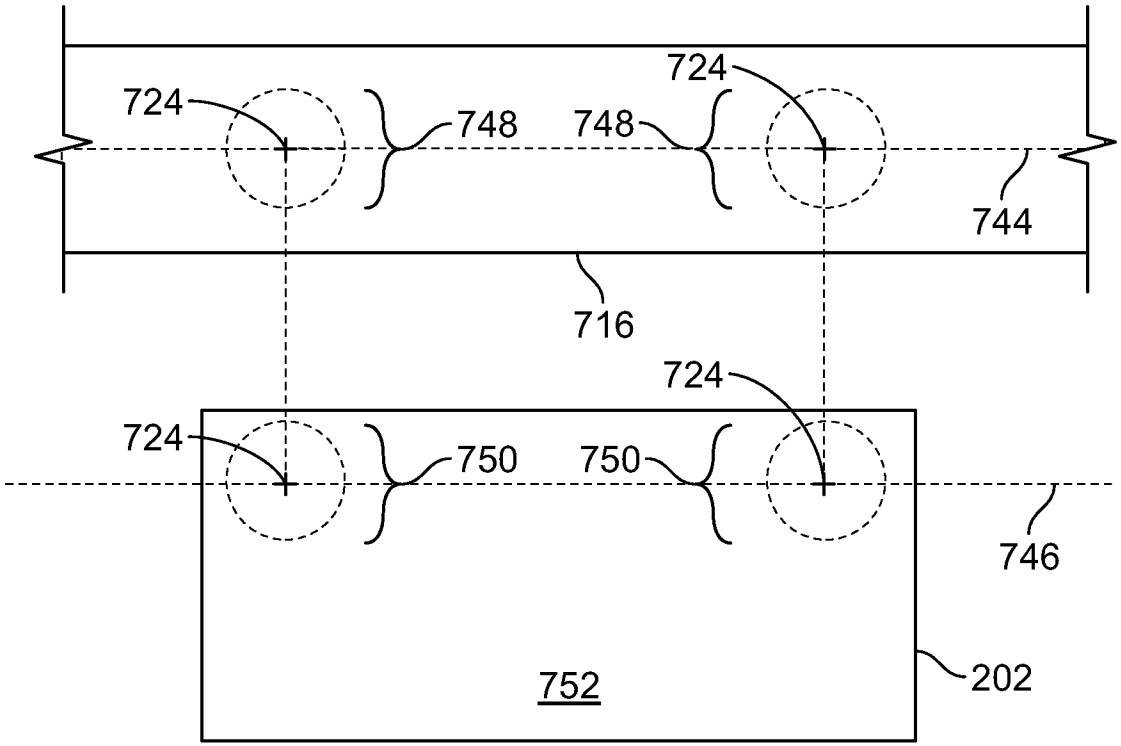
FIG. 7F is a schematic representation of an alignment mask and a substrate of a fluid ejection module.

FIG. 7F is a schematic representation of an implementation of the alignment mask 716 and the substrate 202. The substrate 202 has a nozzle face 752 that can include two or more fiducials 724 (two fiducials in this example). The fiducials 724 on the nozzle face 752 are positioned such that a line defined by such fiducials is parallel to a line defined by the fiducials on the alignment mask when the nozzle face is properly aligned. Because the substrate is attached to the fluid ejection module, proper alignment of the nozzle face of the substrate indicates proper alignment of the fluid ejection module.

The fields of view of the four high magnification cameras 730 are shown as broken circles in FIG. 7F. The fields of view each have a center represented by a crosshair in FIG. 7F for illustrative purposes. The centers of the fields of view of a first pair 748 of high magnification cameras 730 define a first line 744. The centers of the fields of view of a second pair 750 of high magnification cameras 730 define a second line 746. The high magnification cameras 730 are shown having been calibrated by the calibration mask 732, as described above, so the first line 744 and the second line 746 are parallel to each other and separated by a distance D. The first pair 748 of high magnification cameras can be aligned to two of the fiducials 724 on the alignment mask 716. The second pair 750 of high magnification cameras can be positioned over the nozzle face 752 of the fluid ejection module. Because the first line 744 and the second line 746 are parallel, a line defined by the fiducials 724 on the nozzle face 752 is parallel to a line defined by the fiducials on the alignment mask 716 if the nozzle face is properly aligned. Aligning the nozzle face to the second pair of high magnification cameras thus achieves the desired alignment of the remaining degrees of freedom, i.e. x, y, and θz direction. After the module is aligned, a second adhesive can be applied to the sides between the module and module mount to hold the parts together while the first adhesive cures (step 320).

Figure 8:
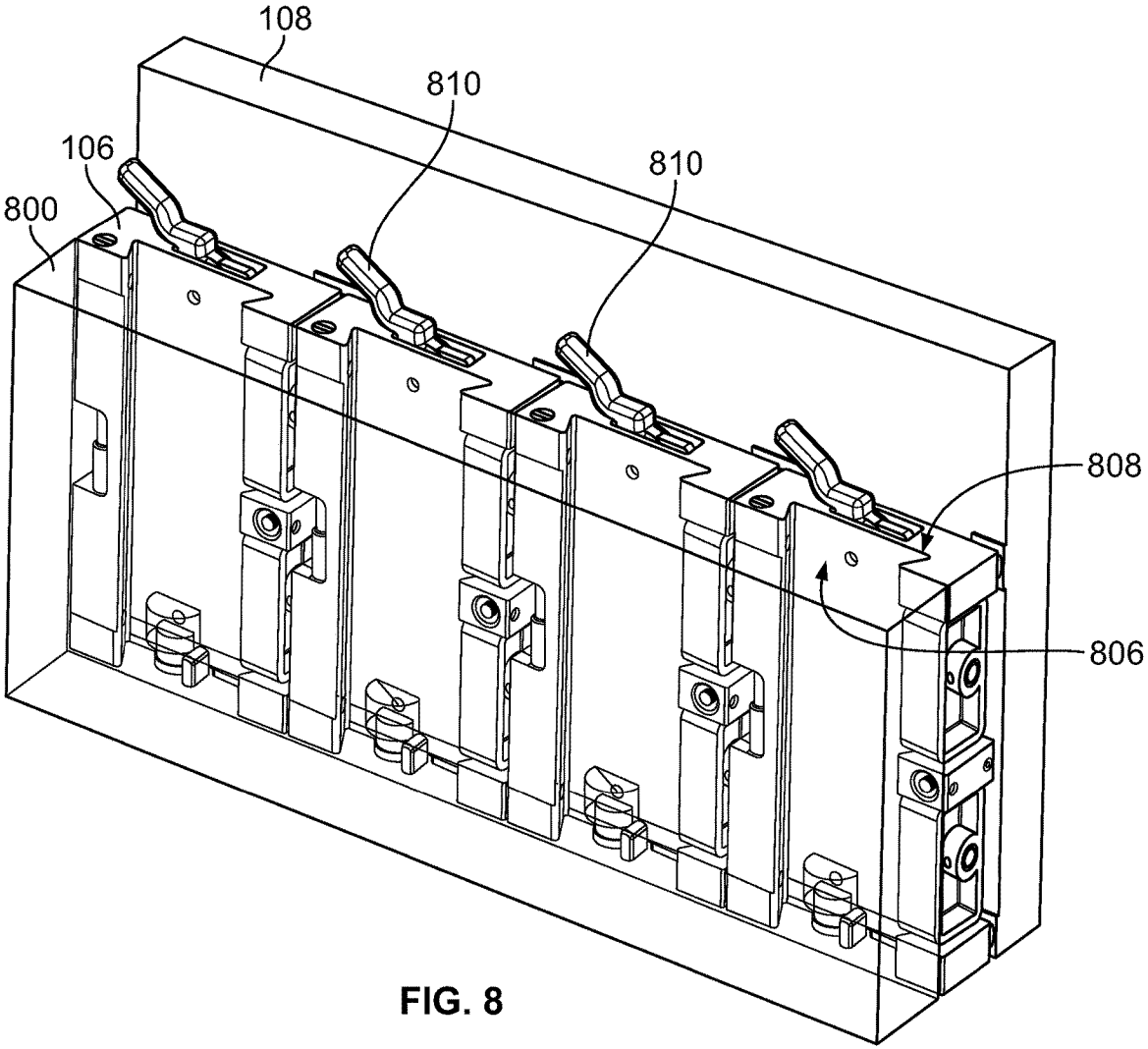
FIG. 8 is a perspective view of an alignment jig (in transparent mode) in a print bar.

Before securing a module mount to the print frame, the clamp assemblies are aligned to a frame (step 330). For example, FIG. 8 shows an alignment jig 800, such as a dovetail jig, that can be used to align clamp assemblies 106 to each other. An alignment jig 800 is a precision mold that represents the shape of the module mounts. The alignment jig can be made of a material with a low CTE, such as invar, kovar, or silicon carbide. The jig can be precision machined using, for example, jig grinding or wire EDM, to an accuracy of 50 microns or less, such as 1 micron or less (e.g., millionths of an inch). An alignment jig 800 aligns the clamp assemblies to the frame 108 and to each other.

Figure 9B:
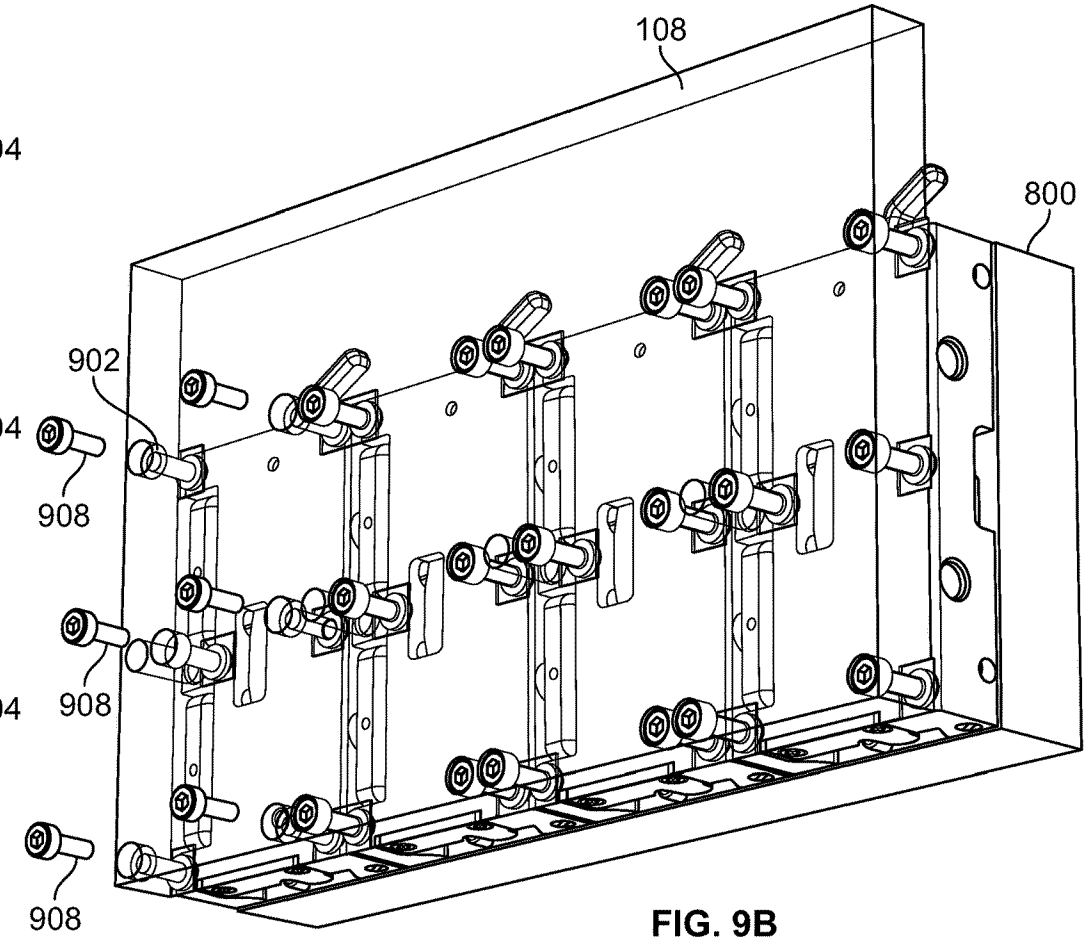
FIGS. 9A and 9B are perspective view of a clamp assembly and print frame (in transparent mode).
Figure 9A:
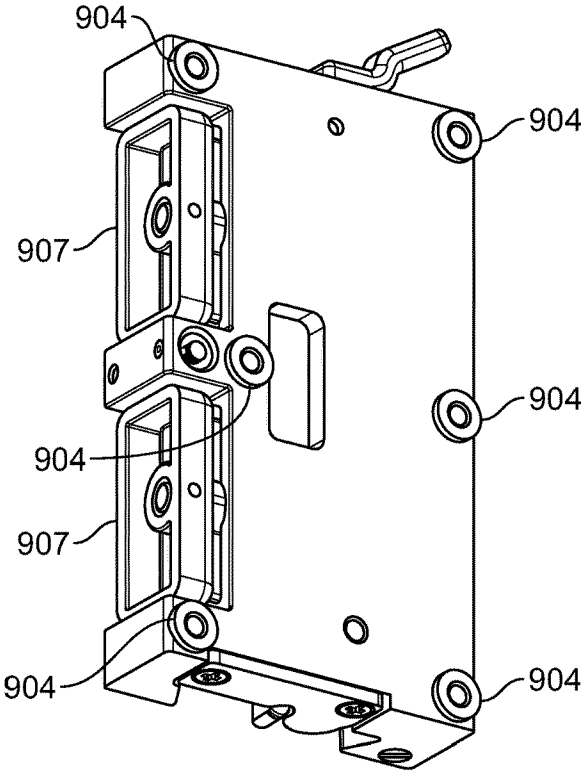
Figure 10:
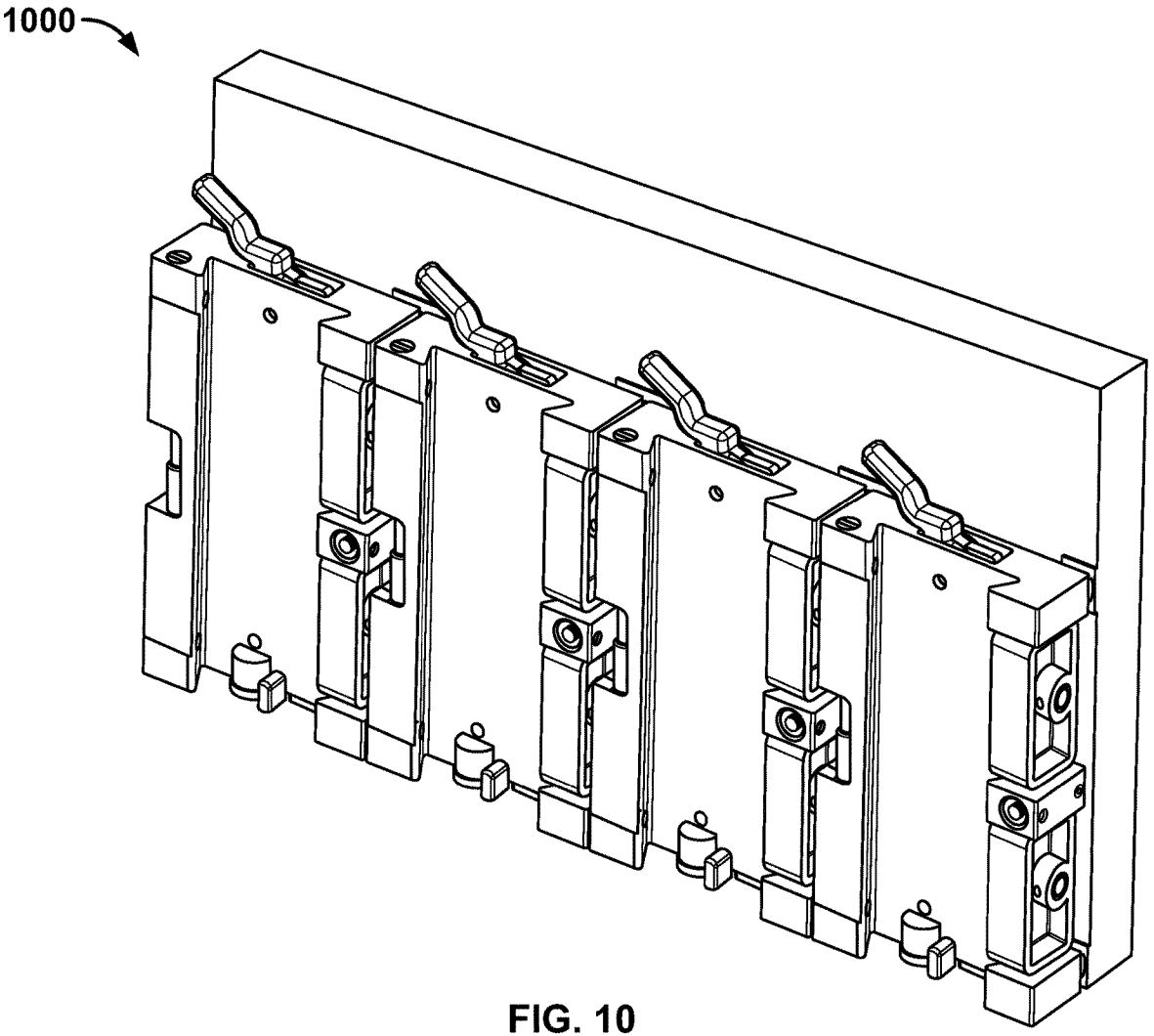
FIG. 10 is a perspective view of an aligned print bar.

FIG. 9A shows the back side of the clamp assembly 106 that can be secured to a frame 108, for example, with screws 908. The clamp assembly 106 includes two retractable clamps 907. FIG. 9A shows precision mounting surfaces 904 (e.g., raised surfaces) that contact the print frame 108. In this case, there are six mounting surfaces. The clamp assemblies can be loosely secured to a frame, for example, by only partly securing the screws. FIG. 9B shows the back side of the frame 108, where the screws 908 can be inserted into threaded openings 902. Other securing means can be used. Next, the alignment jig 800 can be inserted into the clamp assemblies, as shown in FIG. 8. The protruding portions 806 of the alignment jig 800 can mate with the recessed portions 808 of the clamp assemblies 106. After inserting the jig into the clamp assemblies, the clamp levers 810 are moved from an open position to a closed position. The clamp assemblies 106 are then firmly secured to the frame 108, for example, by tightening the screws 908. After firmly securing the clamp assemblies, the clamp levers 810 are opened and the alignment jig 800 is removed, leaving an aligned print bar 1000, as shown in FIG. 10. The individual module mount assemblies can then be loaded in each clamp assembly 106 to form a populated print bar 1100 (step 340), as shown in FIGS. 11A and 11B.

Figure 12:
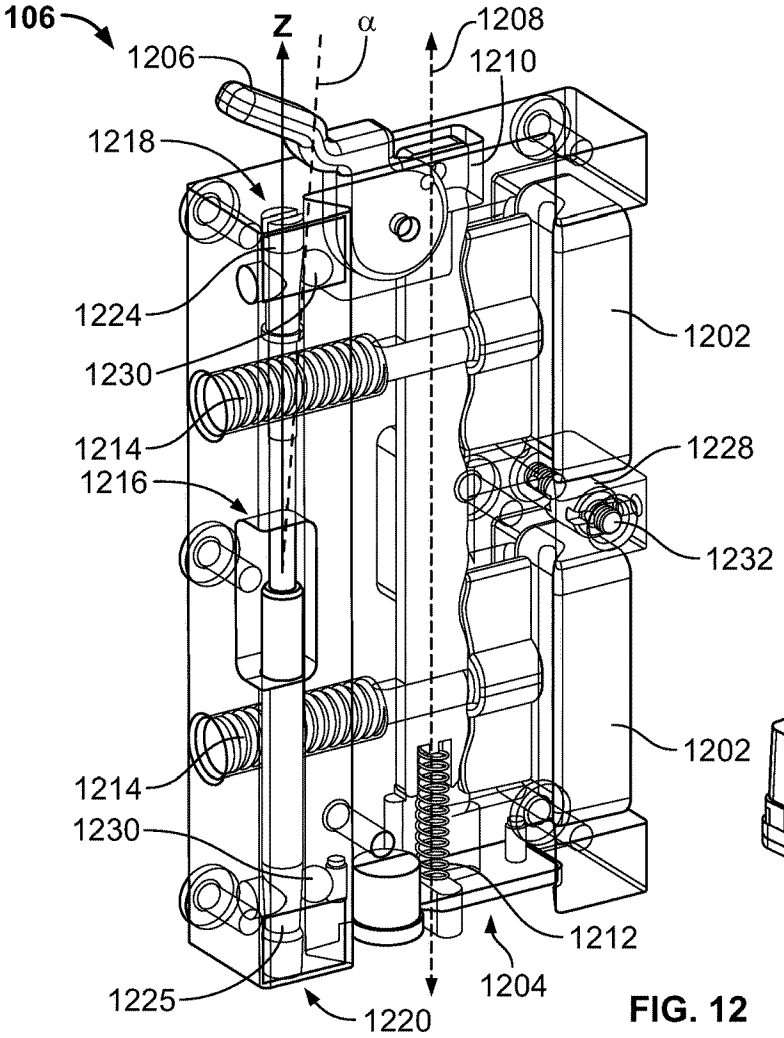
FIG. 12 is a perspective view of a clamp assembly.

To load an individual module mount assembly into the clamp assembly 106, shown in FIG. 12, a lever 1206 is moved to an open position. After loading the module, the lever 1206 is moved from an open position to a closed position. The clamp assembly 106 can include a clamp 1202 along a wall of the recessed portion 1204. In an open position, the lever 1206 can move the clamp 1202 away from a center 1208 of the recessed portion 1204. In a closed position, the lever 1206 can move the clamp 1202 toward a center 1208 of the recessed portion, such that the clamp secures the protruding portion of the module mount to the clamp assembly. To release the module mount, the clamp is moved to the open position.

In an implementation, the clamp assembly 106 can include at least one clamp 1202 (e.g., two clamps are shown in FIG. 12) that is spring-loaded against a retractable cam plate 1210. The retractable cam plate 1210 can be spring-loaded against the lever 1206. In an implementation, in an open position, the lever 1206 is lifted up such that the cam plate 1210 pushes down on the cam plate spring 1212. The cam plate 1210 pushes the clamps 1202 away from the center 1208 of the recessed portion 1204 in the open position. In a closed position, the lever 1206 is pushed down releasing the cam plate 1210 so that the clamp springs 1214 pull the clamps 1202 toward the center 1208 of the recessed portion. In the closed position, the clamps 1202 push against the protruding portion 216 (e.g. dovetail) to firmly hold the module mount 104 in the clamp assembly 106, as shown in FIG. 2A. When the clamps 1202 are closed, the only surfaces that contact are the x, y, and z precision surfaces and corresponding contact points.

Figure 11A:
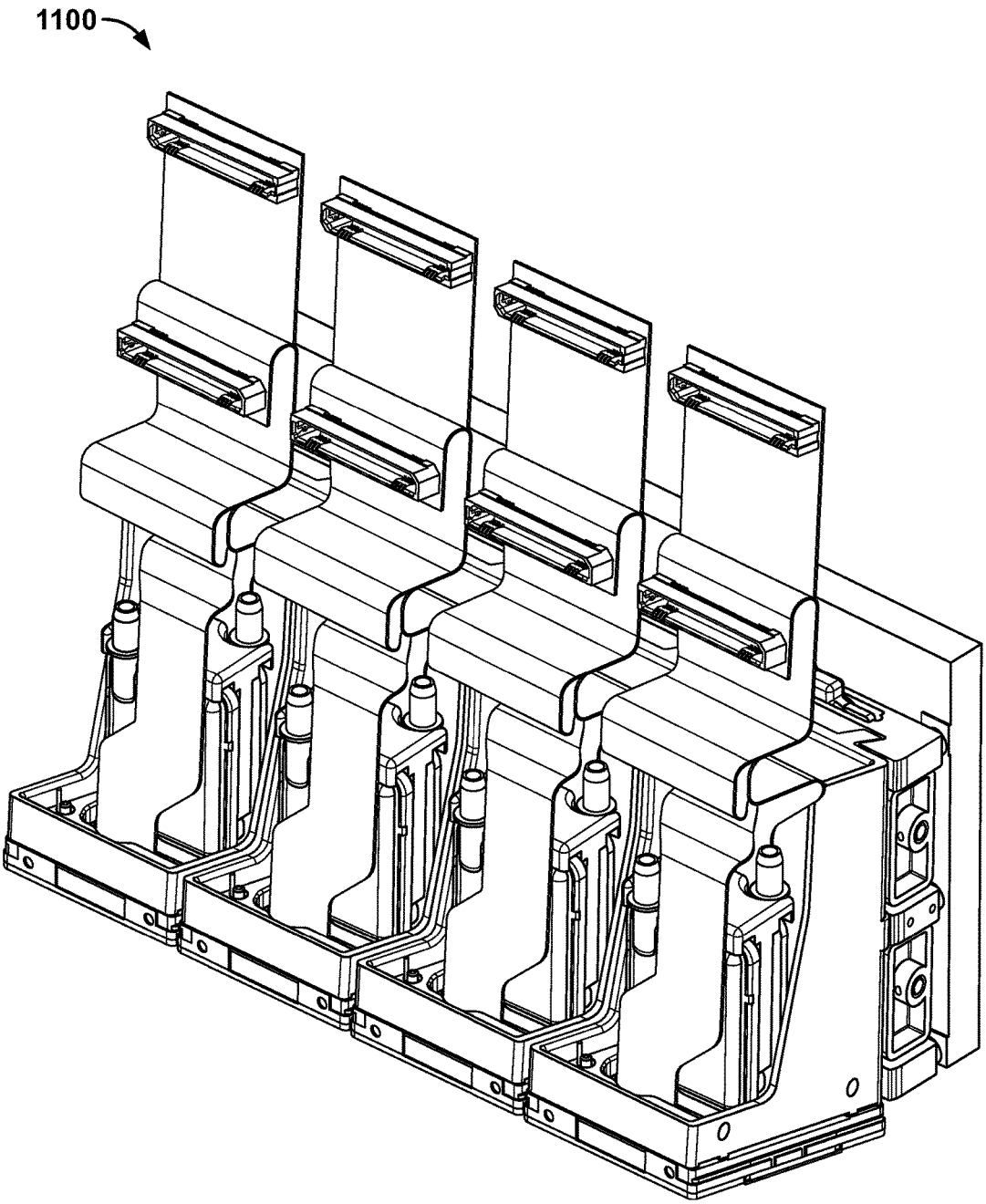
FIGS. 11A and 11B are perspective views of a populated print bar.
Figure 11B:
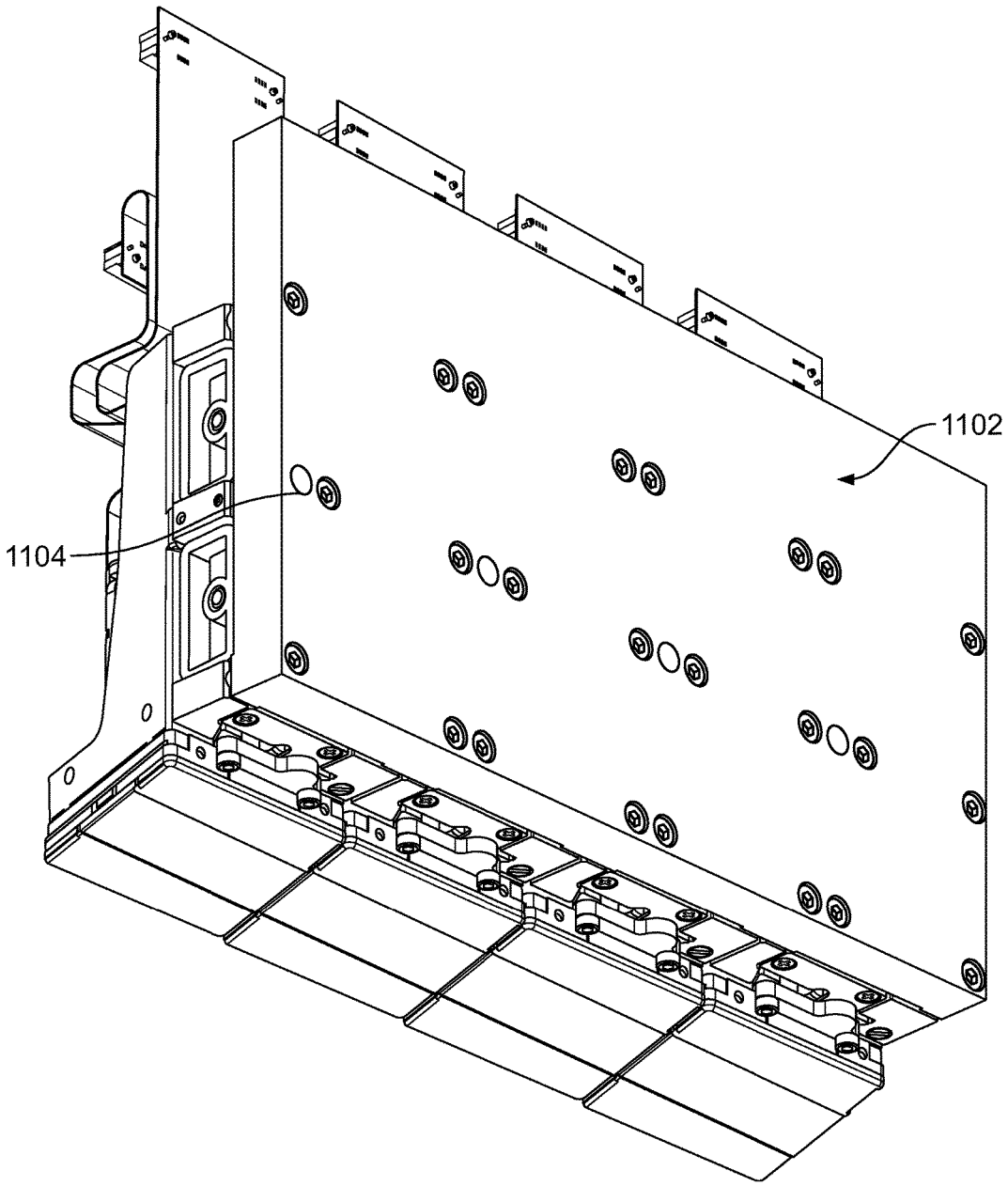

FIGS. 11A and 11B show a populated print bar including a plurality of module mount assemblies fastened to the plurality of clamp assemblies. The alignment process 300 can form a populated print bar with a positional accuracy of ±30 microns in the x-direction and ±10 microns in the θz-direction. The alignment of the modules can be checked using an alignment apparatus similar (or identical) to the alignment apparatus shown in FIG. 7A. If necessary, micro-adjustments can be made to the module mounts using the x and θz adjustments, as discussed below in more detail.

To replace an individual module, the clamp lever is moved to an open position so that the clamps release the module mount. A new module can slide into the clamp assembly, and the clamp lever is moved to a closed position to secure the new module. Any micro-adjustments can be made in the x and θz direction, as described below.

FIG. 12 shows micro-adjustments, e.g., x and θz adjustments 1216, 1228, that can move the x and y contact points 1230, 1232, respectively. To provide more flexibility in integrating the fluid ejection modules in a printer, the adjustments can be accessible from one or more surfaces. For example, the x adjustment mechanism 1216 can be accessible from either the top or bottom surface 1218, 1220 of the clamp assembly 106. The x adjustment mechanism 1216 can include a cam assembly that engages one or more ball bearings mounted in counter bores (e.g. two are shown in FIG. 12). The ball bearings can be the x contact points 1230. The cam assembly can include one or more cams, for example, an upper cam 1224 and a lower cam 1225. The cams are locked together, such that they move together when the cam assembly is adjusted from either the top or bottom 1218, 1220. The cam assembly can fit inside a counter bore in the clamp assembly. The cam assembly can have a threaded section (not shown) between the two cams 1224, 1225 that mates with a threaded section in the counter bore or a threaded nut so that the cam assembly can move up and down within the counter bore. The upper and lower cams are sloped to an angle, α, from the z-axis. The slope can vary depending on the amount of translation in the x-direction specified. When the sloped cams 1224,1225 are rotated, the cam assembly moves the ball bearings in a linear direction, e.g., either right or left. The slope of the cams and the pitch of the threaded section can be designed so that one rotation of the cam assembly translates into moving the module over one pixel in the x-direction.

For example, if the print resolution is 1200 dpi, then the distance between pixels is $1/1200$ inch (about 21 microns). If the threaded section has a pitch of 450 microns (Δy) and the desired x travel is 21 microns (Δx), then the angle, α, of the cams 1224, 1225 would be arctan (Δx/Δy), arctan (21 microns/450 microns), about 2.67° from the z-axis. Thus, one rotation of the cam assembly translates into the ball bearing moving 21 microns in the x-direction, e.g. one pixel.

Table 1 summarizes the x adjustment of a module mount relative to the clamp assembly. Table 1 shows the rotation of a cam assembly (degrees), the number of revolutions, the vertical distance that the cam assembly travels (mm), and the x-direction travel of the ball bearings (microns). For example, the maximum number of degrees that the cam assembly can rotate is 1896°, which is equal to 5.267 revolutions of the cam assembly. This translates into a maximum vertical travel of the cam assembly of 2.37 millimeters and a maximum horizontal travel of the ball bearings of 111.478 microns. For a single revolution, which is 360°, the cam assembly travels vertically 0.45 millimeters and the ball bearings move 21.167 microns (e.g., about one pixel for 1200 dpi).

| X Adjustment | | | | |
|---|---|---|---|---|
| | cam assembly rotation (degrees) | revolutions of cam assembly | vertical distance of cam assembly | X travel (microns) |
| Travel from C/L = | 1896 | 5.267 | 2.37000 | 111.478 |

-continued

| X Adjustment | | | | |
|---|---|---|---|---|
| | cam assembly rotation (degrees) | revolutions of cam assembly | vertical distance of cam assembly | X travel (microns) |
| one 1200 dpi-pixel = | 360 | 1.000 | 0.45000 | 21.167 |
| | 180 | 0.500 | 0.22500 | 10.583 |
| | 170 | 0.472 | 0.21260 | 10 |
| | 90 | 0.250 | 0.11250 | 5.292 |
| | 45 | 0.125 | 0.05625 | 2.646 |
| | 22.5 | 0.063 | 0.02813 | 1.323 |
| | 11.25 | 0.031 | 0.01406 | 0.661 |
| | 10 | 0.028 | 0.01250 | 0.588 |
| | 5 | 0.014 | 0.00625 | 0.294 |
| | 1 | 0.003 | 0.00125 | 0.059 |

Figure 13A:
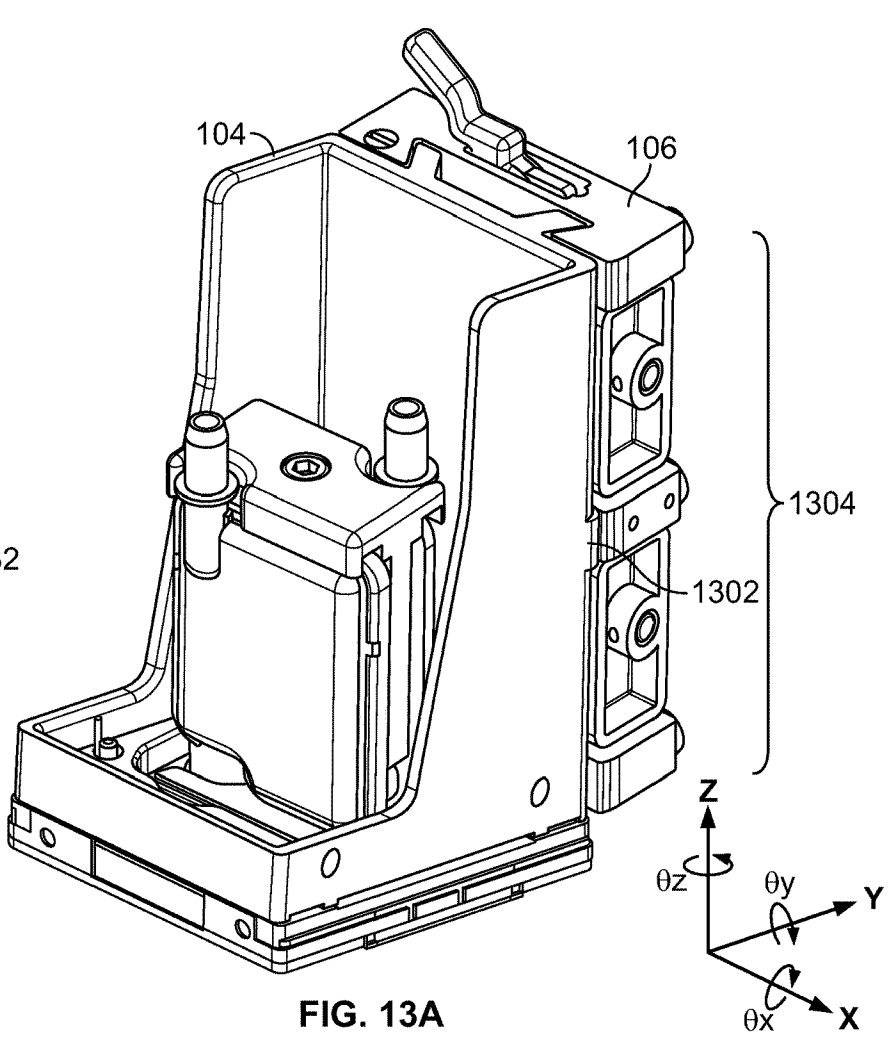
FIGS. 13A and 13B are perspective views of a mounting apparatus including a module mount in clamp assembly.
Figure 13B:
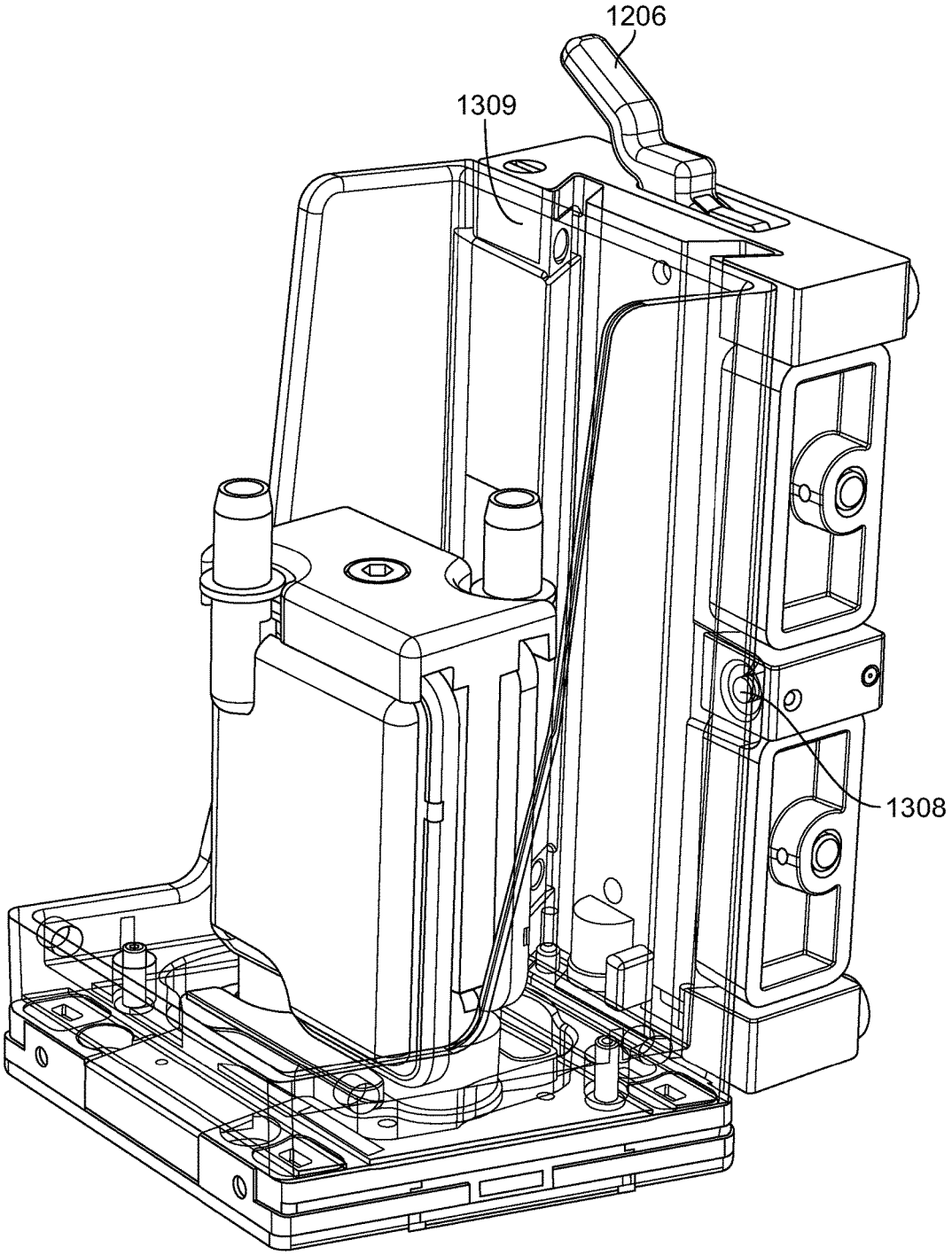

Referring to FIGS. 13A and 13B, the module mount 104 can also be adjusted in the θz direction relative to the clamp assembly 106 using a θz adjustment mechanism. For example, the θz adjustment mechanism can include a y contact point 1308 on the clamp assembly that is adjustable. The other y contact points 1309 (only one shown in FIG. 13B) can be stationary. The y contact point 1308 contacts the y alignment datum 1302 on the vertical portion 1304 of the module mount 104. As the y contact point 1308 moves in a linear direction, the module mount 104 moves in a radial direction relative to the clamp assembly. For example, the y contact point 1308 can be a screw that is movable back and forth in the y-direction causing the module mount to rotate about the z-axis, i.e. θz direction.

Figure 14B:
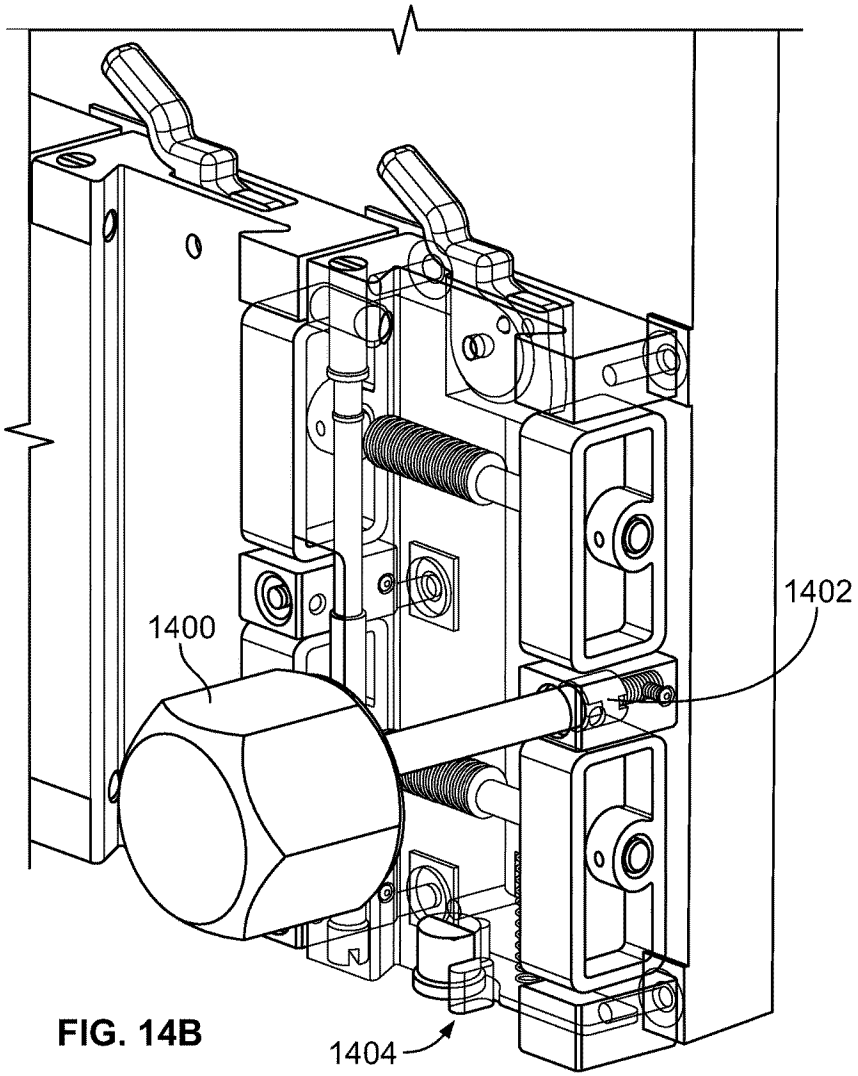
FIGS. 14A and 14B are perspective views of an alignment tool.
Figure 14A:
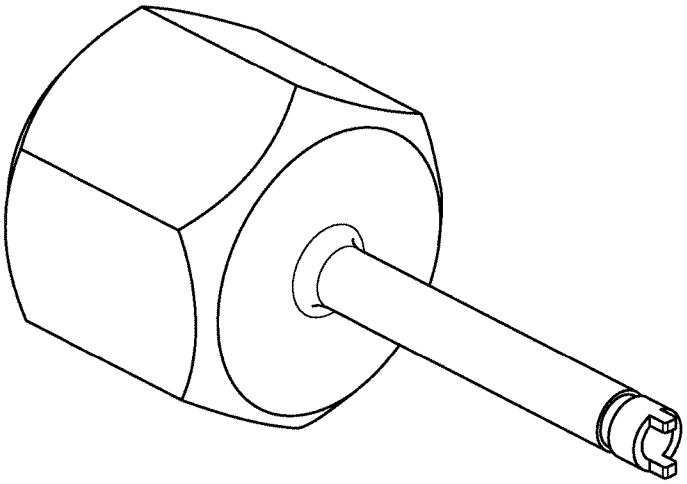

FIG. 14A shows a θz adjustment tool 1400 that mates with the y-direction screw 1402 to make micro-adjustments. FIG. 14B shows the θz tool 1400 adjusting the y-direction screw 1402 from a front surface 1404. To provide more flexibility in integrating the fluid ejection modules in a printer, the y-direction screw 1402 can be accessible from more than one surface, such as a front surface 1404 (FIG. 14B) and a back surface 1102 (FIG. 11B). FIG. 11B shows openings 1104 in the frame 108 for accessing the y-direction screw.

For example, the y-direction screw 1402 can be designed to travel 50 microns or less (e.g., 25 microns or less, 10 microns or less) along the y-axis per revolution of the screw. This can be done by using a screw having a pitch of 50 microns or less, such as 25 microns or less, 10 microns or less. However, this would require making a custom screw, which can be expensive. Alternatively, a differential screw can be used to achieve the same micro-adjustments using screws with standard pitches. A differential screw can include an outer screw with a first pitch and an inner screw with a second pitch, such that the net movement of the differential screw is the difference between the pitch of the outer and the inner screw. For example, to achieve a net movement of 50 microns, the outer screw and inner screw can have a pitch of 0.50 millimeters and 0.45 millimeters, respectively, so that the difference between the two is 50 microns. Thus, one revolution of the differential screw equals 50 microns of travel along the y-axis. As the differential screw moves the y contact point, the module rotates about the z-axis. For example, a movement of 50 microns in the y-direction with a pivot distance of about 38 mm translates into a rotation in the θz-direction of about 1.32 milliradians (mr) (i.e., arctan (y travel/pivot distance)).

Table 2 summarizes the θz adjustment of a module mount 104 relative to the clamp assembly 106. Table 2 shows the rotation of a differential screw (degrees), the number of revolutions of the outer screw, the travel of the outer screw in the y direction (mm), the travel of the differential screw in the y direction (microns), and the rotation of the module mount in the θz direction (mr). For example, the maximum number of degrees that the differential screw can rotate is 1800°, which is equal to 5 revolutions of the outer screw. This translates into a travel of about 2.5 mm for the outer screw and 250 microns of travel for the differential screw. This results in about 6.58 mr of movement of the module mount in the θz direction. In another example, for a single revolution, which is 360°, the outer screw can travel 0.5 mm while the differential screw moves 50 microns, which results in about 1.32 mr of movement of the module mount in the θz direction. Table 2 provides additional calculations for 180°, 152.4°, 90°, 76.2°, 45°, 22.5°, 11.25°, 10°, 5°, and 1°, where 152.4° and 76.2° represent a pixel and a half a pixel, respectively, for a 1200 dpi print resolution. Other configurations for the differential screw as well as other combinations for the pitches of the screws are possible.

| θz adjustment<br>Using differential screw having:<br>0.50 mm pitch outer screw thread<br>0.45 mm pitch inner screw thread<br>difference of 0.05 mm travel/revolution | | | | | |
|---|---|---|---|---|---|
| screw rotation (degrees) | revolutions of outer screw | Y travel of outer screw (mm) | Y travel of differential screw (microns) | Z rotation (milliradians) | |
| | | | | 38 | =pivot distance in mm |
| 1800 | 5.000 | 2.50000 | 250.0 | 6.5789 | =Travel from C/L |
| 360 | 1.000 | 0.50000 | 50.0 | 1.3158 | |
| 180 | 0.500 | 0.25000 | 25.0 | 0.6579 | |
| 152.4 | 0.423 | 0.21167 | 21.1667 | 0.5570 | =One pixel (1200 dpi) Y travel |
| 90 | 0.250 | 0.12500 | 12.5 | 0.3289 | |
| 76.2 | 0.212 | 0.10583 | 10.6 | 0.2785 | =½ pixel (1200 dpi) Y travel |
| 45 | 0.125 | 0.06250 | 6.250 | 0.1645 | |
| 22.5 | 0.063 | 0.03125 | 3.125 | 0.0822 | |
| 11.25 | 0.031 | 0.01563 | 1.563 | 0.0411 | |
| 10 | 0.028 | 0.01389 | 1.389 | 0.0365 | |
| 5 | 0.014 | 0.00694 | 0.694 | 0.0183 | |
| 1 | 0.003 | 0.00139 | 0.139 | 0.0037 | |

The use of terminology such as "front," "back," "top," "bottom," "over," "above," and "below" throughout the specification and claims is for describing the relative positions of various components of the system, printhead, and other elements described herein. Similarly, the use of any horizontal or vertical terms to describe elements is for describing relative orientations of the various components of the system, printhead, and other elements described herein. Unless otherwise stated explicitly, the use of such terminology does not imply a particular position or orientation of the printhead or any other components relative to the direction of the Earth gravitational force, or the Earth ground surface, or other particular position or orientation that the system, printhead, and other elements may be placed in during operation, manufacturing, and transportation.

A number of embodiments of the invention have been described. Nevertheless, it will be understood that various modifications may be made without departing from the spirit and scope of the inventions.

What is claimed is:

1. A method of aligning a fluid ejection module mounting apparatus, comprising:

attaching a plurality of clamp assemblies to a frame, each clamp assembly including a contact surface that contacts the frame and one or more contact points having a position adjustable relative to the surface;

attaching a plurality of ejection modules to a plurality of module mounts with different ejection modules attached to different module mounts, wherein each module mount comprises one or more alignment datums, and wherein each ejection module comprises a nozzle surface having a plurality of nozzles;

for each respective module mount, after attaching a respective clamp assembly to the frame and after attaching a respective ejection module to the respective module mount, securing the respective module mount to the respective clamp assembly such that the one or more alignment datums engage the one or more contact points; and bringing the nozzles of at least one ejection module attached to a respective module mount attached to a respective clamp assembly into a desired alignment with the frame by adjusting the position of the one or more contact points of the respective clamp assembly.

2. The method of claim 1, wherein attaching the plurality of clamp assemblies to the frame includes securing the plurality of clamp assemblies to an alignment jig by clamping each clamp assembly onto the alignment jig, securing the plurality of clamp assemblies to the frame while the clamp assemblies are clamped to the jig, and removing the alignment jig from the plurality of clamp assemblies.

3. The method of claim 2, comprising loosely attaching the plurality of clamp assemblies to the frame before securing the plurality of clamp assemblies to the alignment jig, and wherein securing the plurality of clamp assemblies comprise more firmly attaching the clamp assemblies to the frame.

4. The method of claim 1, wherein attaching the plurality of ejection modules to the plurality of module mounts includes aligning the ejection modules to the module mounts using fiducial marks on a nozzle layer of the ejection modules.

5. The method of claim 4, wherein attaching the plurality of ejection modules to the plurality of module mounts includes bonding the plurality of ejection modules to the plurality of module mounts with an adhesive.

6. The method of claim 4, wherein attaching the plurality of ejection modules to the plurality of module mounts includes fixing the plurality of ejection modules to the plurality of module mounts with screws.

7. The method of claim 4, wherein aligning the ejection modules to the module mounts comprises aligning a plurality of cameras to an alignment mask, and aligning fiducial marks on the nozzle layer to be parallel to fiducial marks on the alignment mask.

8. The method of claim 1, wherein bringing the nozzles into the desired alignment comprises adjusting the position of the at least one contact point to move the module mount in a direction parallel to the nozzle surface.

9. The method of claim 1, wherein bringing the nozzles into the desired alignment comprises adjusting the position of the at least one contact point to rotate the module mount about an axis perpendicular to the nozzle surface.

10. The method of claim 1, wherein securing the respective module mount to the respective clamp assembly comprises sliding a projection from the respective module mount onto a complementary recess in the respective clamp assembly.

11. The method of claim 10, wherein securing the respective module mount to the respective clamp assembly comprises causing opposed surfaces of the clamping assembly to push inwardly against the projection from the respective module mount.

12. The method of claim 10, wherein the projection comprises a dovetail.

13. The method of claim 10, wherein causing opposed surfaces of the clamping assembly to push inwardly against the projection comprises shifting a lever coupled to the clamping assembly from an open position to a closed position.

14. The method of claim 10, wherein causing opposed surfaces of the clamping assembly to push inwardly against the projection comprises biasing a first of the opposed surfaces with a spring against the projection.

* * * * *